US007329393B2

(12) United States Patent
Backes et al.

(10) Patent No.: US 7,329,393 B2
(45) Date of Patent: Feb. 12, 2008

(54) CAPACITY ALTERING DEVICE, HOLDER, AND METHODS OF SAMPLE PROCESSING

(75) Inventors: Bradley J. Backes, Chicago, IL (US); Jim Chang, San Diego, CA (US); John Isbell, San Diego, CA (US); James K. Mainquist, San Diego, CA (US); Christopher M. Shaw, San Diego, CA (US)

(73) Assignee: IRM LLC, Hamilton (BM)

( * ) Notice: Subject to any disclaimer, the term of this patent is extended or adjusted under 35 U.S.C. 154(b) by 169 days.

(21) Appl. No.: 10/682,781

(22) Filed: Oct. 8, 2003

(65) Prior Publication Data

US 2004/0126283 A1 Jul. 1, 2004

Related U.S. Application Data

(60) Provisional application No. 60/417,782, filed on Oct. 10, 2002, provisional application No. 60/436,672, filed on Dec. 27, 2002.

(51) Int. Cl.
*B01L 3/00* (2006.01)

(52) U.S. Cl. ..... 422/102; 422/99; 422/100; 422/104

(58) Field of Classification Search ..... 422/99, 422/101, 102, 129, 130, 131, 100, 104
See application file for complete search history.

(56) References Cited

U.S. PATENT DOCUMENTS 5,290,520 A * 3/1994 Maystre et al. ..... 422/82.05
5,464,541 A 11/1995 Aysta et al.
5,624,815 A * 4/1997 Grant et al. ..... 435/30
5,746,975 A 5/1998 Chateau
5,824,272 A 10/1998 Uchida et al.
6,054,100 A * 4/2000 Stanchfield et al. ..... 422/102
6,083,761 A * 7/2000 Kedar et al. ..... 436/178

(Continued)

FOREIGN PATENT DOCUMENTS

WO WO 99/00655 1/1999

(Continued)

OTHER PUBLICATIONS

Isolute® product brochure, "Accessories and filtration products for sample preparation." pp. 1-20 of 20. 2001 International Sorbent Technology Ltd.

(Continued)

*Primary Examiner*—Jill Warden
*Assistant Examiner*—Dwayne K. Handy
(74) *Attorney, Agent, or Firm*—Timothy L. Smith; Genomics Institute of the Novartis Research Foundation

(57) ABSTRACT

This invention provides capacity altering devices that facilitate the processing of samples whose volume exceeds the capacity of external sample processing regions (e.g., sample tubes or wells). The invention also provides holders that can be used with such devices, e.g., to allow centrifugation of the devices and/or to minimize handling of the external processing regions. Methods of processing samples, particularly samples whose volume exceeds the capacity of the external processing regions, and methods of collecting compounds in external processing regions are another feature of the invention.

11 Claims, 25 Drawing Sheets

U.S. PATENT DOCUMENTS

| | | | | |
|---|---|---|---|---|
| 6,309,828 | B1 * | 10/2001 | Schleifer et al. | 435/6 |
| 6,338,802 | B1 | 1/2002 | Bodner et al. | |
| 6,402,950 | B1 | 6/2002 | Nix et al. | |
| 6,419,827 | B1 * | 7/2002 | Sandell et al. | 210/321.75 |
| 6,436,351 | B1 | 8/2002 | Gubernator et al. | |
| 6,461,287 | B1 | 10/2002 | Glater | |
| 6,485,692 | B1 * | 11/2002 | Freitag et al. | 422/130 |
| 6,503,457 | B1 | 1/2003 | Neeper et al. | |
| 6,592,826 | B1 * | 7/2003 | Bloecker et al. | 422/101 |
| 6,817,558 | B1 * | 11/2004 | Karlsson et al. | 241/30 |
| 6,830,732 | B1 * | 12/2004 | Hoffman et al. | 422/101 |
| 6,852,290 | B2 * | 2/2005 | Hager et al. | 422/101 |
| 2001/0001644 | A1 | 5/2001 | Coffman et al. | |
| 2004/0096986 | A1 | 5/2004 | Klein et al. | |

FOREIGN PATENT DOCUMENTS

| | | |
|---|---|---|
| WO | WO 02/16035 | 2/2002 |

OTHER PUBLICATIONS

ScreenMates® product brocure, "ScreenMates Range." pp. 1-2 of 2. 2002 Matrix Technologies.

Thompson Instrument Company. "Thompson Filter Plates 5mL" on the World Wide Web at http://www.htslabs.com/HTML/Wellplates/FilterPlates/5mL%20Filter%20Plates.html p. 1 of 1. Sep. 29, 2002.

Thompson Instrument Company. "Evaporation Proof Cap Mats" on the World Wide Web at http://www.htslabs.com/HTML/Wellplates/CapMatsLids/Evaporation%20Proof.html p. 1 of 1. Sep. 29, 2002.

* cited by examiner

CAPACITY ALTERING DEVICE, HOLDER, AND METHODS OF SAMPLE PROCESSING

CROSS REFERENCE TO RELATED APPLICATIONS

This application is a non-provisional utility patent application claiming priority to and benefit of the following prior provisional patent applications: U.S. Ser. No. 60/417,782, filed Oct. 10, 2002, entitled "Capacity altering device, holder, and methods of sample processing" by Bradley J. Backes et al., and U.S. Ser. No. 60/436,672, filed Dec. 27, 2002, entitled "Capacity altering device, holder, and methods of sample processing" by Bradley J. Backes et al., each of which is incorporated herein by reference in its entirety for all purposes.

FIELD OF THE INVENTION

The present invention is in the field of sample handling, particularly liquid sample handling. The invention includes devices that facilitate the processing of samples whose volume exceeds the capacity of external sample processing regions (e.g., sample tubes or wells). The invention also includes holders that can be used with such devices, as well as methods for processing samples whose volume exceeds the capacity of external processing regions and methods of collecting compounds in external processing regions.

BACKGROUND OF THE INVENTION

High-throughput purification to provide high-quality compounds for evaluation is an important part of combinatorial chemistry technology platforms. Typically, preparatory scale purification is employed with some form of detection (e.g., mass spectroscopic detection, ultraviolet/visible wavelength (UV/Vis) detection, luminescence, evaporative light-scattering (ELS) detection, refractive index (RI) detection, electrochemical detection, and/or chemiluminescence nitrogen (CLN) detection) to collect the fractions that contain the compounds of interest. Compounds to be purified are often presented to the purification system in 96 well deep well plates of standard footprint (e.g., 96 wells in twelve columns and eight rows). An ideal work flow would process a block of 96 unpurified compounds to provide a 96 well block of purified compounds and would involve a limited number of operations. For example, the unpurified compound at a particular position of a multiwell plate (e.g., Al) would be injected onto the purification system and separated, with the fraction containing the purified compound being collected in the corresponding position (e.g., Al) of the deep well collection block. However, many preparatory purification systems provide the compound of interest in a 2-10 mL fraction, while the volume of even a deep well plate is typically at most only 2.2-4 mL and many standard centrifugal vacuum concentrators require 20-30% of the collection vessel to remain empty to allow for solvent expansion under vacuum and/or spill-free sample processing. This necessitates several concentration, reconstitution, and transfer steps that can drastically increase the complexity of this process.

The present invention overcomes the above noted difficulty by providing a temporarily increased (and optionally adjustable) capacity for sample processing regions such as e.g., the wells of a 96 well plate. A complete understanding of the invention will be obtained upon review of the following.

SUMMARY OF THE INVENTION

The present invention provides holders and capacity altering devices that can facilitate the processing of samples whose volume exceeds the capacity of external processing regions (e.g., sample tubes or wells). Methods, e.g., methods of processing such samples, are another feature of the invention.

In a first general class of embodiments, the invention provides a holder for use in a centrifuge. The holder comprises a base, a top plate comprising a plurality of apertures, and a coupling mechanism that couples the base to the top plate in at least a first fixed position. The holder, when in the first fixed position, is configured to be inserted into a centrifuge carrier and rotated in a centrifuge (e.g., a centrifugal vacuum concentrator). The coupling mechanism can movably or removably couple the top plate to the base, and can comprise, e.g., at least one screw, hinge, or clamp that attaches to the base, the top plate, or both. Alternatively, the coupling mechanism can permanently couple the top plate to the base, and can comprise, e.g., at least two side supports or side walls.

One or more structures (e.g., sample tubes) collectively comprising a plurality of external processing regions can be disposed between the top plate and the base. At least one body structure can be disposed on the top plate such that the top plate is between the body structure and the one or more structures comprising the external processing regions. The body structure comprises a plurality of first access apertures connected to and separated from a plurality of second access apertures by a plurality of inner cavities, which comprise a plurality of internal processing regions. The body structure and the one or more structures are removably sealed such that the internal processing regions are removably sealed to the external processing regions.

In a class of related embodiments, the invention provides a holder for use in a centrifuge. The holder comprises a base plate, a lid, and a coupling mechanism that couples the base plate to the lid, typically in a least a first fixed position. The holder when in the first fixed position is configured to be inserted into a centrifuge carrier and rotated in a centrifuge. The coupling mechanism can comprise, e.g., at least one screw, hinge, or clamp that attaches to the base plate, the lid, or both. The holder can be used to contain a capacity altering device. Thus, one or more structures collectively comprising a plurality of external processing regions (e.g., sample tubes or wells of a multiwell plate) and at least one body structure can be disposed between the lid and the base plate. The body structure comprises a plurality of first access apertures connected to and separated from a plurality of second access apertures by a plurality of inner cavities, which comprise a plurality of internal processing regions. The body structure and the one or more structures are removably sealed such that the internal processing regions are removably sealed to the external processing regions. The lid can comprise one or more third access apertures, each of which allows access to one or more of the first access apertures in the body structure. The holder can further comprise, e.g., one or more tube racks, a vacuum manifold, and/or an ejection mechanism.

In an additional class of related embodiments, the invention provides a holder comprising a base plate, a lid, and a coupling mechanism that couples the base plate to the lid in at least a first fixed position. The lid comprises at least one aperture that permits delivery of one or more samples through the lid when the holder is in the first fixed position. The base plate comprises at least one vacuum manifold comprising a plurality of apertures in the base plate. The coupling mechanism can comprise, e.g., at least one screw, hinge, or clamp that attaches to the base plate, the lid, or both. The holder can be used to contain a capacity altering device. Thus, one or more structures collectively comprising a plurality of external processing regions (e.g., sample tubes or wells of a multiwell plate) and at least one body structure can be disposed between the lid and the base plate. The body structure comprises a plurality of first access apertures connected to and separated from a plurality of second access apertures by a plurality of inner cavities, which comprise a plurality of internal processing regions. The body structure and the one or more structures are removably sealed such that the internal processing regions are removably sealed to the external processing regions.

In a second general class of embodiments, the invention provides a capacity altering device. The device comprises at least one body structure, a plurality of external processing regions, and at least one sealing mechanism. The body structure comprises a plurality of first access apertures connected to and separated from a plurality of second access apertures by plurality of inner cavities, which comprise a plurality of internal processing regions having a first capacity. The sealing mechanism is coupled to or configured to be coupled to the body structure, and is configured to removably seal the plurality of internal processing regions with the plurality of external processing regions, each of which has a second capacity. The device can optionally be contained in a holder.

The external processing regions can comprise, e.g., wells of a standard multiwell plate or sample containers such as sample tubes. The external processing regions and the internal processing regions can be removably sealed by direct contact between the body structure and the external processing regions. In one embodiment, the sealing mechanism comprises a plurality of extensions (e.g., straight or angled extensions) projecting from a bottom surface of the body structure that form pressed, radial seals with the external processing regions. Alternatively, the external and internal processing regions can be removably sealed without direct contact between the body structure and the external processing regions. For example, the sealing mechanism can comprise at least one gasket, e.g., located between the body structure and the external processing regions.

Systems comprising capacity altering devices are also a feature of the invention. In one class of embodiments, the device further comprises an upstream purification module (e.g., a module comprising a fraction collector, a standard preparatory liquid chromatography system, and/or a supercritical fluid chromatography system) fluidly connected to the device (e.g., to at least one combined processing region).

In a third general class of embodiments, the invention provides methods of processing samples. One class of embodiments provides methods of centrifuging a sample. In the methods, a container, a sample, and a holder comprising a base plate and a lid are provided. The sample is placed into the container, which is placed between the base plate and the lid. The container is secured in the holder by closing the lid. The holder is placed into a centrifuge rotor and the rotor is rotated to centrifuge the sample. The container can be a capacity altering device. Thus, the container can comprise a plurality of external processing regions removably sealed with a plurality of internal processing regions to form a plurality of combined processing regions. The sample can be placed into at least one of the combined processing regions, and the total volume of the sample added to at least one combined processing region can exceed the capacity of the external processing regions.

In a related class of embodiments, the invention provides methods of performing a sample processing operation. In the methods, a plurality of internal processing regions are removably sealed with a plurality of external processing regions to form a plurality of combined processing regions. Each of the internal processing regions has a first capacity, and each of the external processing regions has a second capacity. One or more volumes of sample comprising one or more compounds are added to the plurality of combined processing regions, and the total volume added to at least one of the combined processing regions exceeds the second capacity of the external processing regions. The one or more compounds are processed in the plurality of combined processing regions.

In one class of preferred embodiments, a plurality of compounds are processed simultaneously. The processing can comprise, e.g., evaporating a solvent from the samples, centrifuging the samples, and/or purifying the one or more compounds. The one or more volumes of sample can be, e.g., one or more fractions from a standard preparatory liquid chromatography system, and a plurality of such fractions (e.g., about 24, about 48, or about 96 fractions) can be collected in the combined processing regions and processed (e.g., concentrated) simultaneously. The methods can further comprise additional steps. For example, the internal and external processing regions can be uncoupled, and the one or more compounds can be processed (e.g., weighed) in the external processing regions at one or more workstations.

In another related class of embodiments, the invention provides methods of collecting one or more compounds. In the methods, at least one internal processing region is removably sealed with at least one external processing region to form at least one combined processing region. Each internal processing region has a first capacity, and each external processing region has a second capacity. One or more volumes of sample comprising one or more compounds are added to the combined processing region, and at least a portion of the one or more compounds is collected in the external processing region. The internal and external processing regions are then uncoupled. The sample comprising the compound(s) is typically a liquid or solid entrained in a gas (e.g., an aerosol). In one class of preferred embodiments, the one or more volumes of sample comprise one or more fractions from at least one supercritical fluid chromatography (SFC) system.

Figure 1:
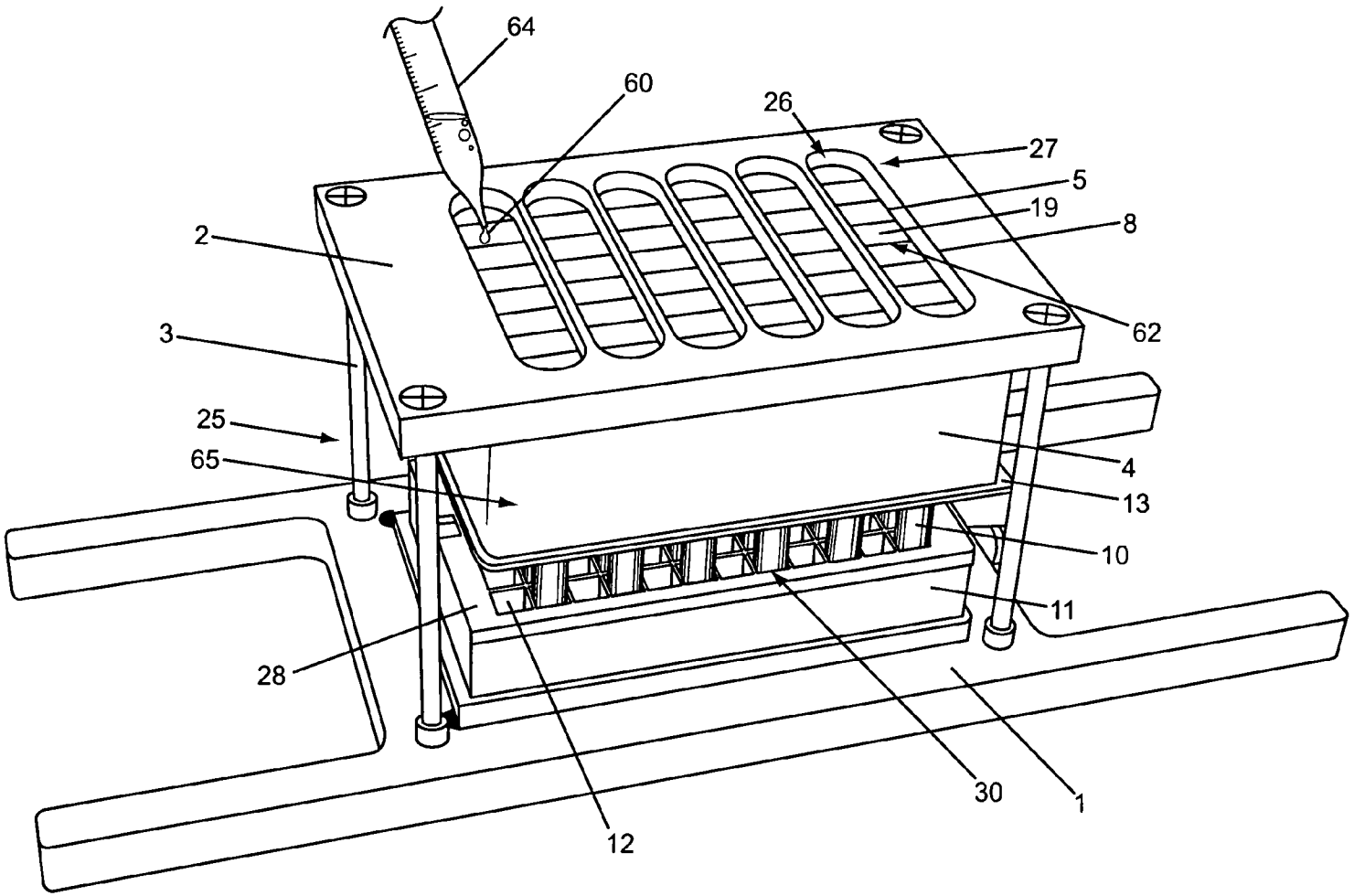
FIG. 1 depicts a capacity altering device contained in a holder.

Some or all of the above figures may be schematic.

DETAILED DESCRIPTION

The present invention provides, e.g., holders and capacity altering devices that facilitate sample handling and methods of processing samples. One general class of embodiments provides holders that can contain at least one capacity altering device or a portion thereof (e.g., sample tubes or a multiwell plate). The holders can, for example, be configured to allow centrifugation of a device contained or partially contained in the holder and/or can comprise features that minimize the amount of handling (e.g., of sample tubes) required during use of such a device. Another general class of embodiments provides capacity altering devices. These devices are particularly useful in processing samples whose volume exceeds the capacity of external sample processing regions (e.g., sample tubes or wells). A third general class of embodiments provides methods of processing samples, particularly samples whose volume exceeds the capacity of the external processing regions, and methods of collecting samples in external processing regions.

Holder

One aspect of the present invention provides holders. The holders can contain, e.g., at least one capacity altering device or a portion thereof. For example, the holders can be configured to allow centrifugation of the capacity altering device, or to minimize the amount of handling (e.g., of sample tubes) that is required during use of such a device.

Holder

One class of embodiments provides a holder for use in a centrifuge. The holder comprises a base, a top plate comprising a plurality of apertures, and a coupling mechanism that couples the base to the top plate in at least a first fixed position. The base, coupling mechanism, and top plate are configured such that, when they are in the first fixed position (e.g., closed), the holder can be inserted into a centrifuge carrier and rotated in a centrifuge.

The centrifuge carrier can be, e.g., a rotor (e.g., the holder can be inserted directly into a rotor bucket or placed on a rotor shelf), an adapter configured to be inserted into a rotor (e.g., the holder can be inserted into an adapter that fits in a rotor bucket or onto a rotor shelf), or an adapter configured to be attached to a rotor. The centrifuge can be, e.g., a stand-alone centrifuge or can be attached to or part of additional equipment. For example, the centrifuge can be part of a centrifugal vacuum concentrator (e.g., a SpeedVac). One of skill will recognize that a number of centrifuge rotors (including centrifugal vacuum concentrator rotors) are generally commercially available (e.g., from Kendro Laboratory Products, www.sorvall.com, ThermoSavant, www.thermo-.com, or Genevac, www.genevac.com), and that appropriate modifications (e.g., to the size and shape of the base, or the height of the closed holder) can be made to configure the holder for use with various of these rotors.

The coupling mechanism can comprise, e.g., at least one screw, at least one hinge, or at least one clamp, wherein the screw, hinge, and/or clamp attaches to the base, the top plate, or both. In one embodiment, the coupling mechanism comprises four (or more) screws that attach the top plate to the base in the first fixed position.

In another class of embodiments, the coupling mechanism permanently couples the top plate to the base in the first fixed position. The coupling mechanism can comprise, e.g., at least two side supports or side walls.

The plurality of apertures in the top plate can comprise essentially any desired number (e.g., 2 or more, 8 or more, 12 or more, 24 or more, 48 or more, or 96 or more) and can be arranged in essentially any convenient format. For example, the plurality of apertures can comprise 48 apertures spatially arranged to correspond to the arrangement of the wells of a standard 48 well multiwell plate (e.g., the 48 apertures can be arranged in six columns and eight rows). Similarly, the apertures can comprise 96 apertures spatially arranged to correspond to the wells of a standard 96 well multiwell plate (e.g., the 96 apertures can be arranged in twelve columns and eight rows), 24 apertures spatially arranged to correspond to the wells of a standard 24 well multiwell plate, 384 apertures spatially arranged to correspond to the wells of a standard 384 well multiwell plate, or 1536 apertures spatially arranged to correspond to the wells of a standard 1536 well multiwell plate. (It will be evident that the above refers to the spatial arrangement or layout of the apertures, not their size and/or shape. The apertures need not be the same size and/or shape as the mouths of the wells of the multiwell plate.) As another example, the apertures can be spatially arranged to correspond to a custom design (e.g., an array having any number of rows and/or columns, an array in which adjacent rows and/or columns are offset or staggered with respect to each other, or an array not characterized by rows and/or columns).

The holder can be used to hold and optionally to centrifuge various containers, objects, etc. In one class of embodiments, the holder contains a portion of at least one capacity altering device and can be used to centrifuge the device. In this class of embodiments, one or more structures that collectively comprise a plurality of external processing regions are disposed between the top plate and the base of the holder. In certain embodiments, at least one body structure is disposed on the top plate such that the top plate is between the body structure and the one or more structures comprising the external processing regions. The at least one body structure comprises a plurality of first access apertures that are connected to and separated from a plurality of second access apertures by a plurality of inner cavities that comprise a plurality of internal processing regions. (In embodiments in which the holder contains, e.g., portions of two or more capacity altering devices, each device comprises a body structure comprising a plurality of internal processing regions.) The body and the one or more structures are removably sealed with each other, such that the internal processing regions are removably sealed to the external processing regions. The seal can be formed through direct contact between the body structure and the one or more structures comprising the external processing regions, or, e.g., at least one gasket can be disposed between the body structure and the external processing regions.

In certain embodiments, there are an equal number of second access apertures in the body structure and apertures in the top plate of the holder, and the apertures in the top plate are spatially arranged to correspond to the positions of the second access apertures.

The external processing regions can comprise, e.g., a plurality of the wells of at least one standard 24, 48, 96, 384, or 1536 well multiwell plate, or any type of sample container. In one class of embodiments, the external processing regions comprise a plurality of sample tubes (e.g., test tubes, vials, microcentrifuge tubes, or mini tubes). In one useful embodiment, the diameter of the apertures in the top plate is less than the maximal outer diameter of each sample tube. In this embodiment, the body structure can be detached from the sample tubes, e.g., by lifting the body structure up while the top plate retains the sample tubes in the holder, thereby uncoupling the internal and external processing regions.

The sample tubes can optionally be positioned in at least one tube rack. Each tube rack can have a top surface comprising a plurality of apertures spatially arranged to correspond to the wells of a standard 24, 48, 96, 384, or 1536 well multiwell plate or to a custom design (e.g., any number of apertures, in an array having any number of rows and/or columns, an array in which adjacent rows and/or columns are offset or staggered with respect to each other, or an array not characterized by rows and/or columns).

The holder can be fabricated from essentially any convenient material or materials. Materials can be selected on the basis of mechanical strength, solvent resistance, ease of fabrication, or other characteristics, and can include, e.g., a metal (e.g., stainless steel, aluminum, titanium, or the like), a metalloid, a polymer such as a plastic (e.g., an acrylic or an acetal, e.g., Delrin®), a ceramic (e.g., glass), a composite, or a cellulose-based material (e.g., wood). In preferred embodiments, the top plate and/or the base comprises aluminum (e.g., Teflon®-impregnated black anodized aluminum) or an acetal (e.g., Delrin®).

Figure 13:
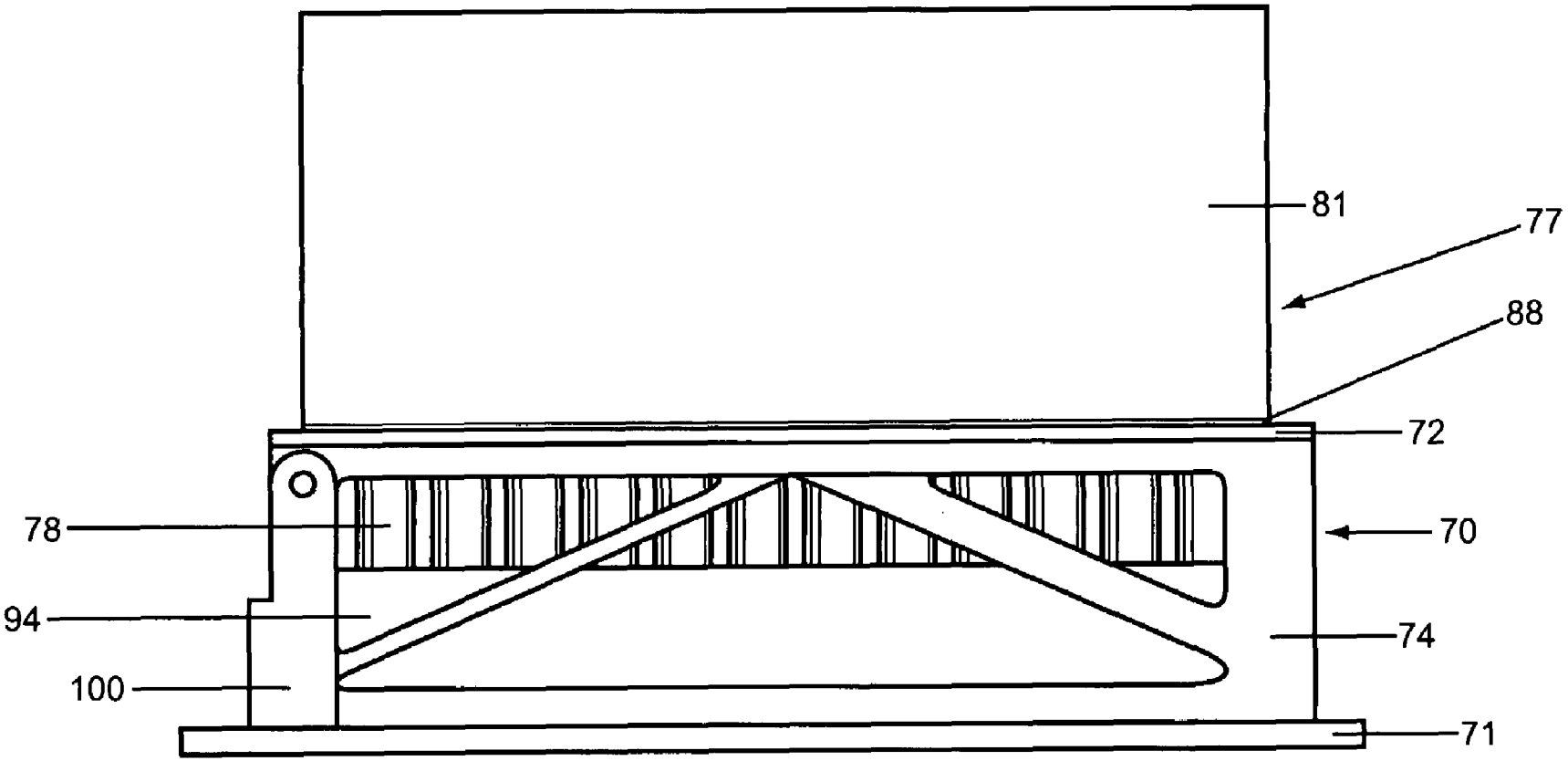
FIG. 13 is a side view of a capacity altering device where the external processing regions are contained in a holder.
Figure 14:
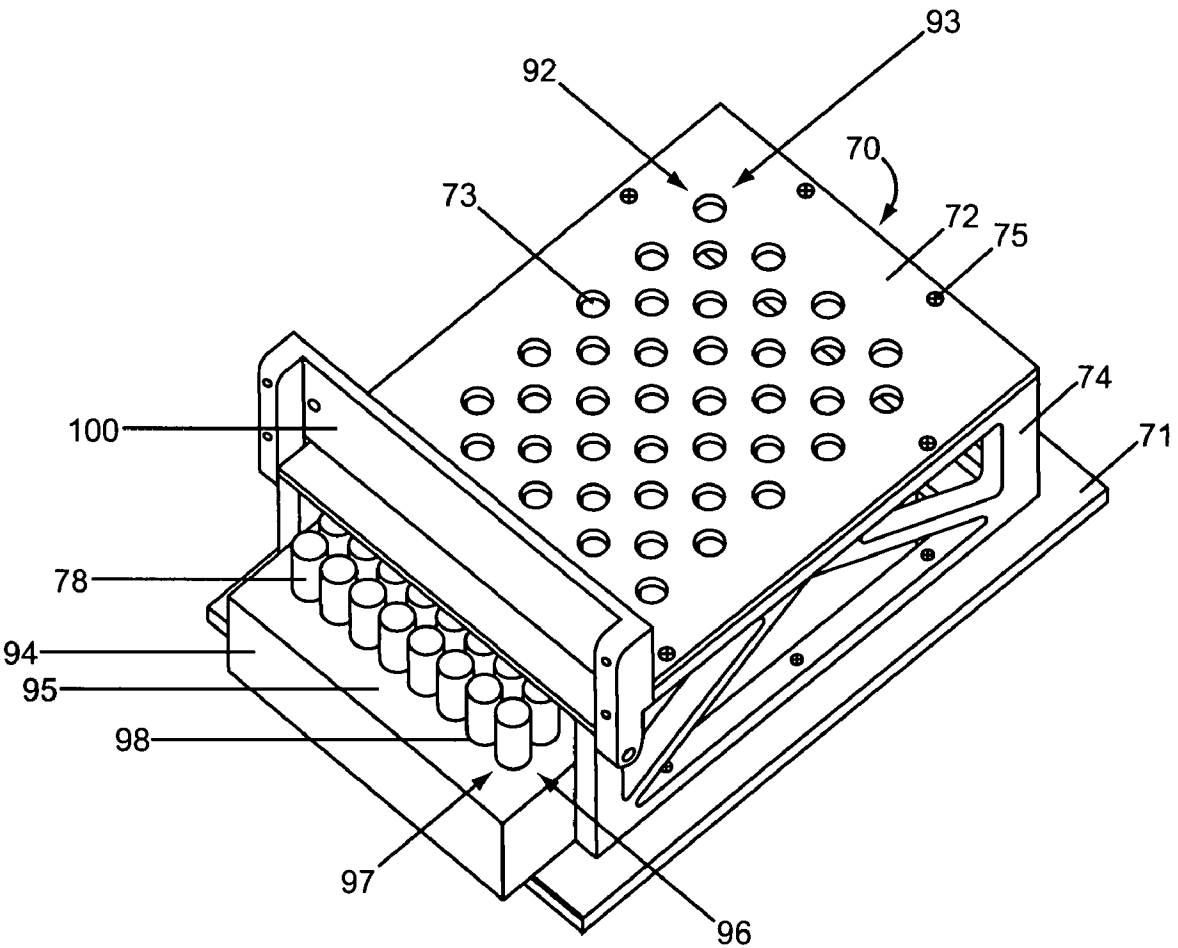
FIG. 14 depicts the external processing regions and open holder of the capacity altering device of FIG. 13.
Figure 15:
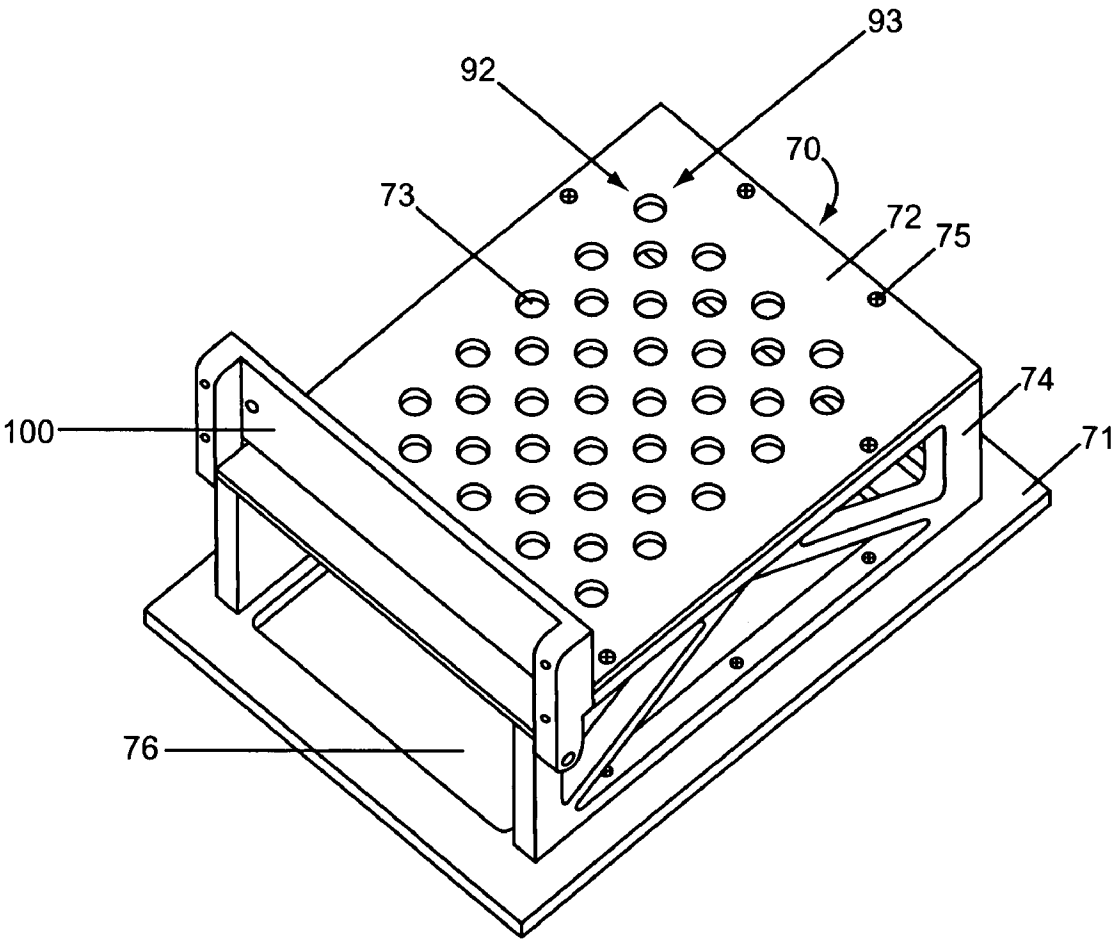
FIG. 15 depicts the open holder of the capacity altering device of FIG. 13.
Figure 16:
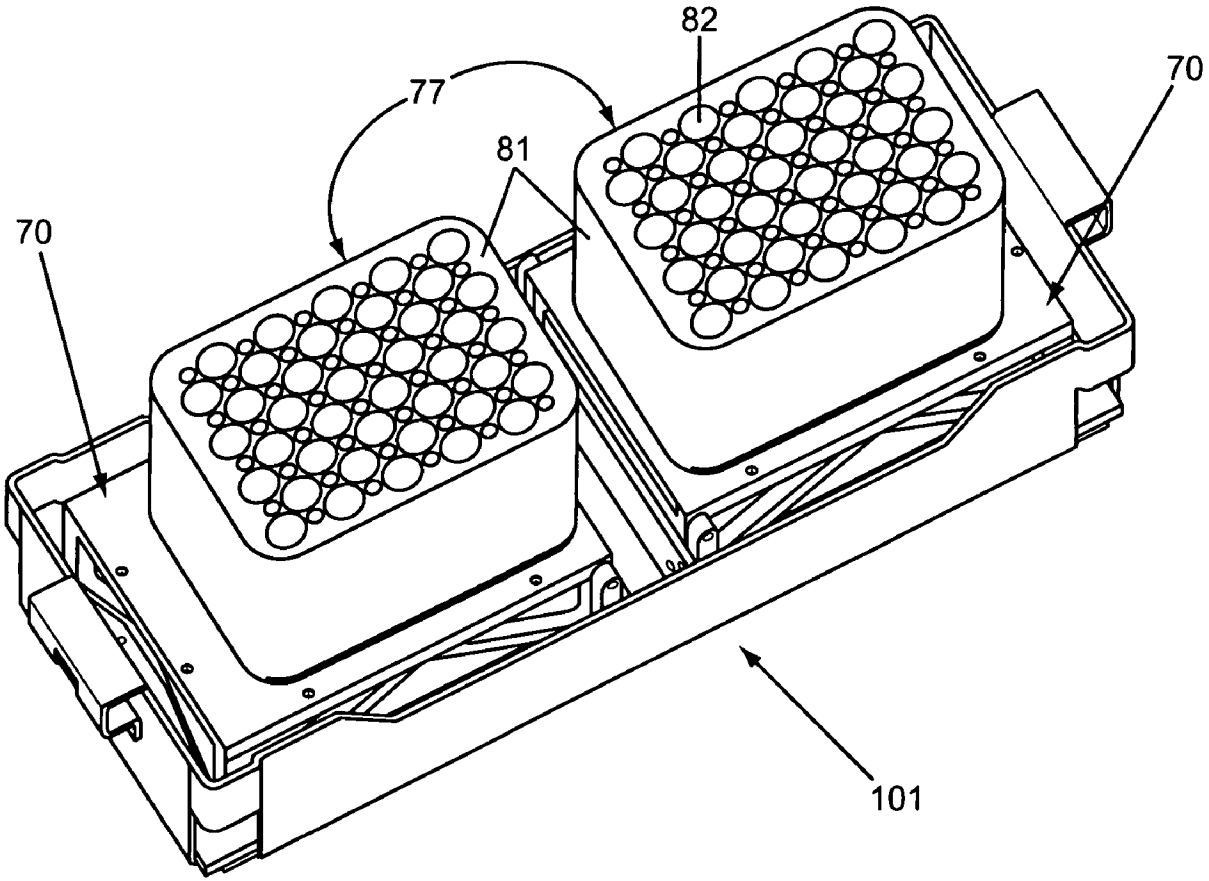
FIG. 16 depicts two holders and capacity altering devices as in FIG. 13 positioned in a centrifuge (a centrifugal vacuum concentrator) carrier.
Figure 17:
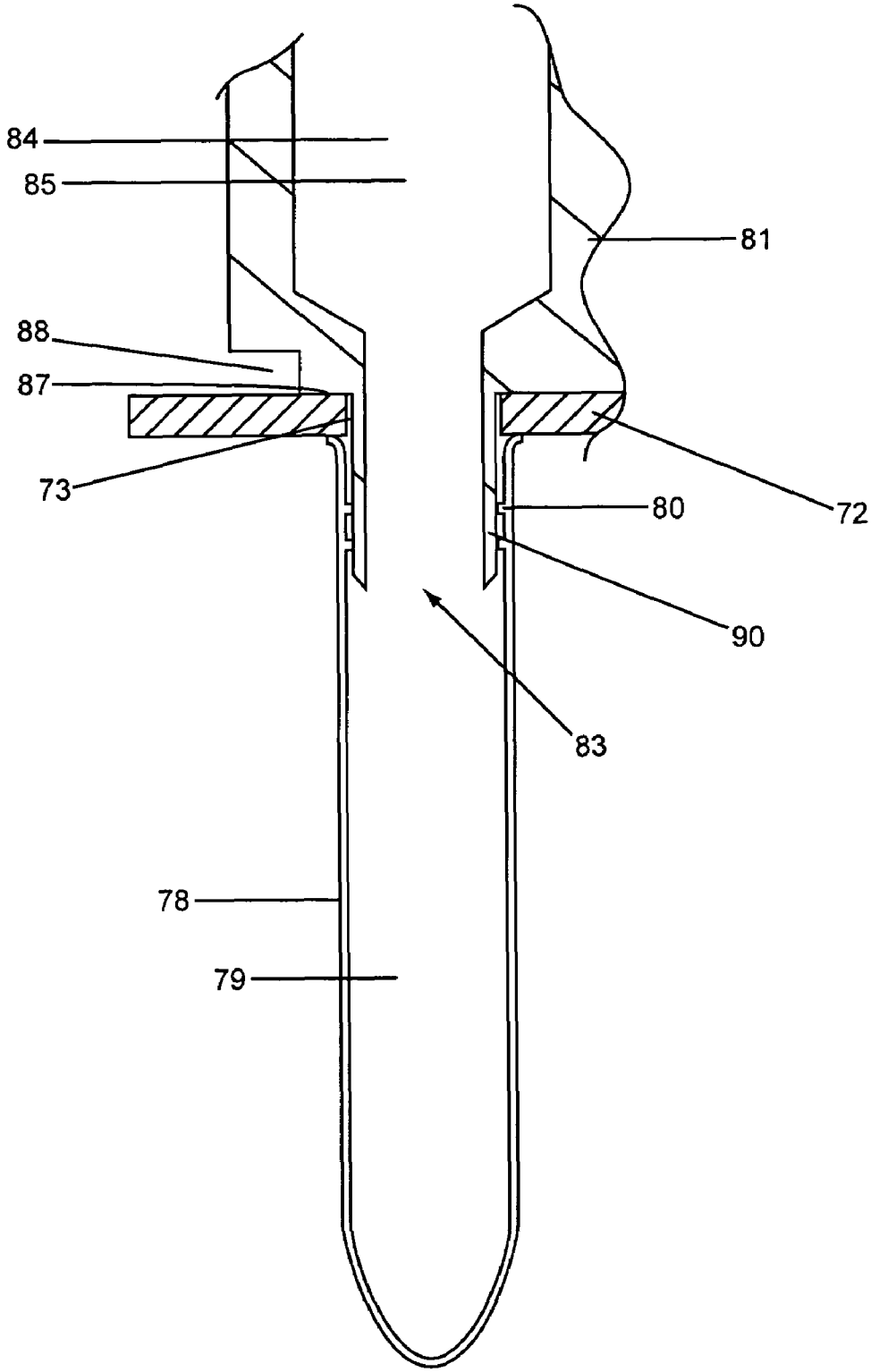
FIG. 17 is a cross-section of a portion of the capacity altering device of FIG. 13.
Figure 18:
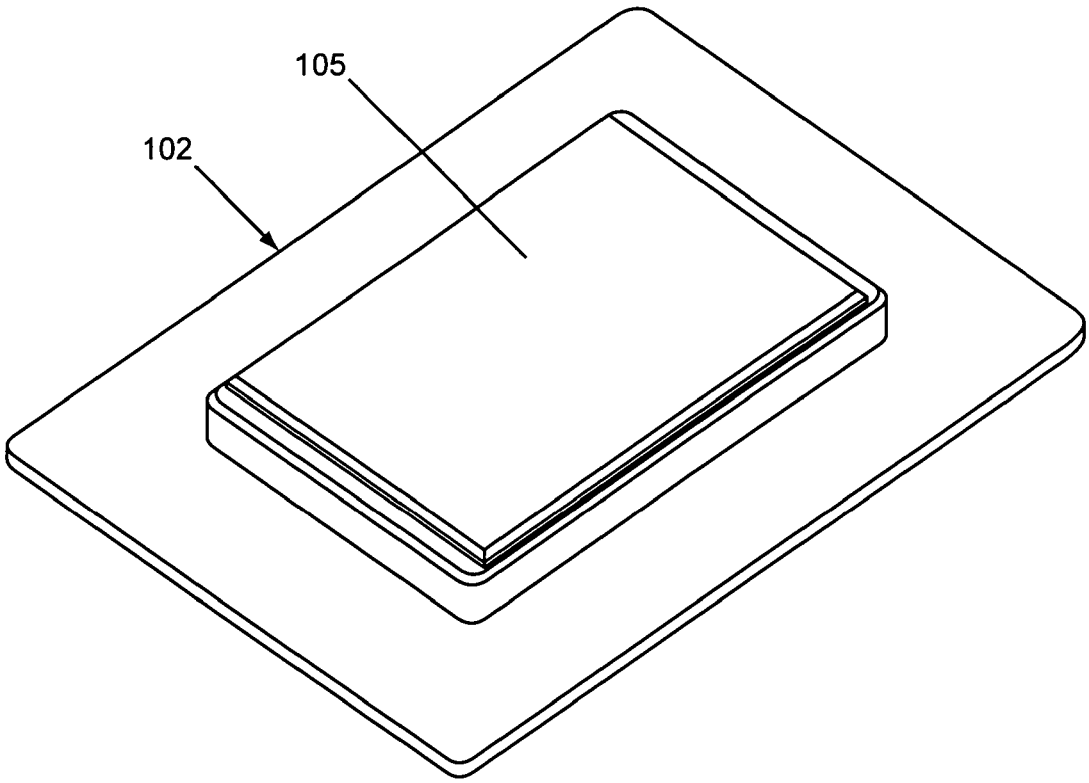
FIG. 18 depicts a loading support platform for use with the holder for the capacity altering device of FIG. 13.
Figure 19:
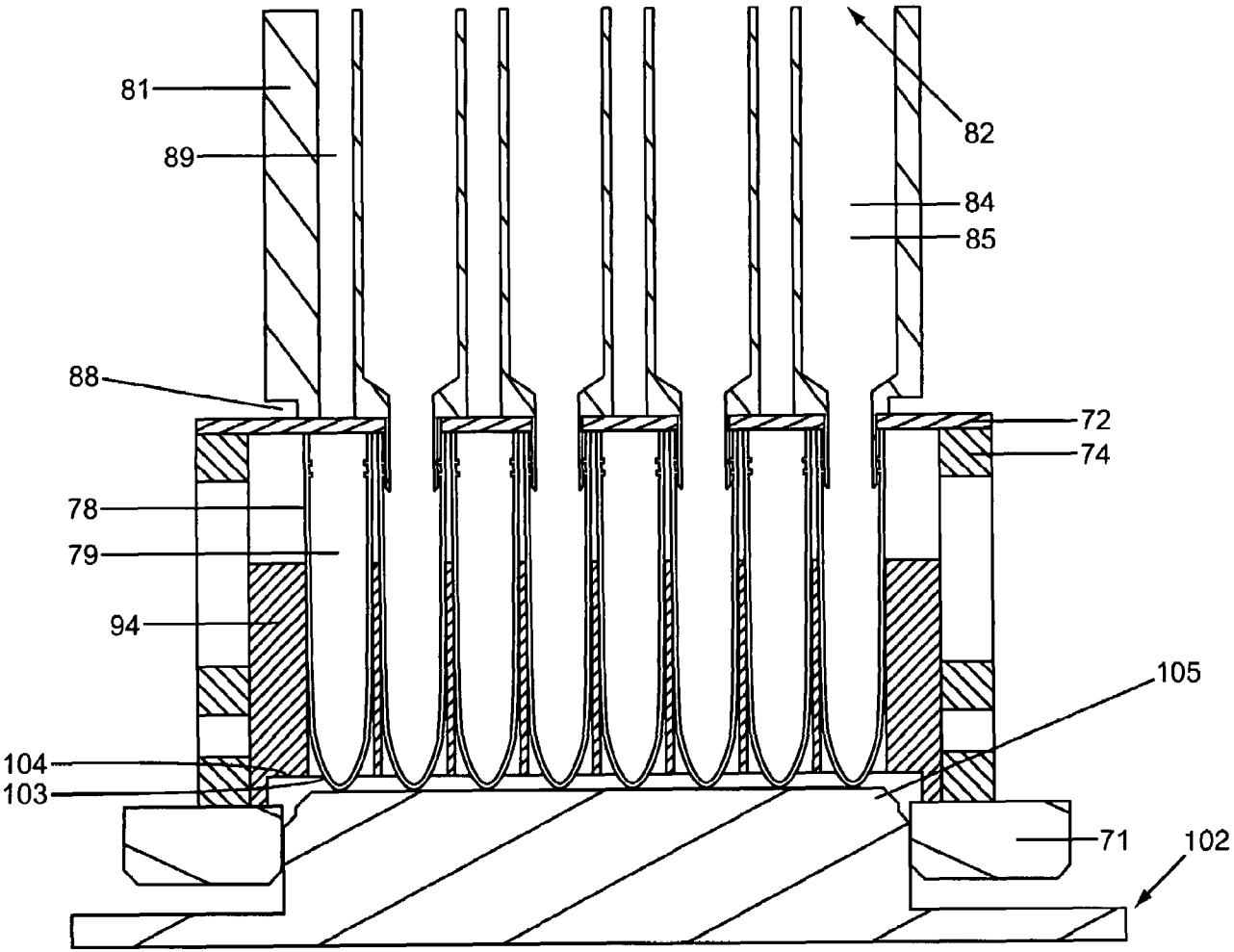
FIG. 19 is a cross-section of a portion of the capacity altering device and holder of FIG. 13 resting on the loading support platform of FIG. 18.
Figure 20:
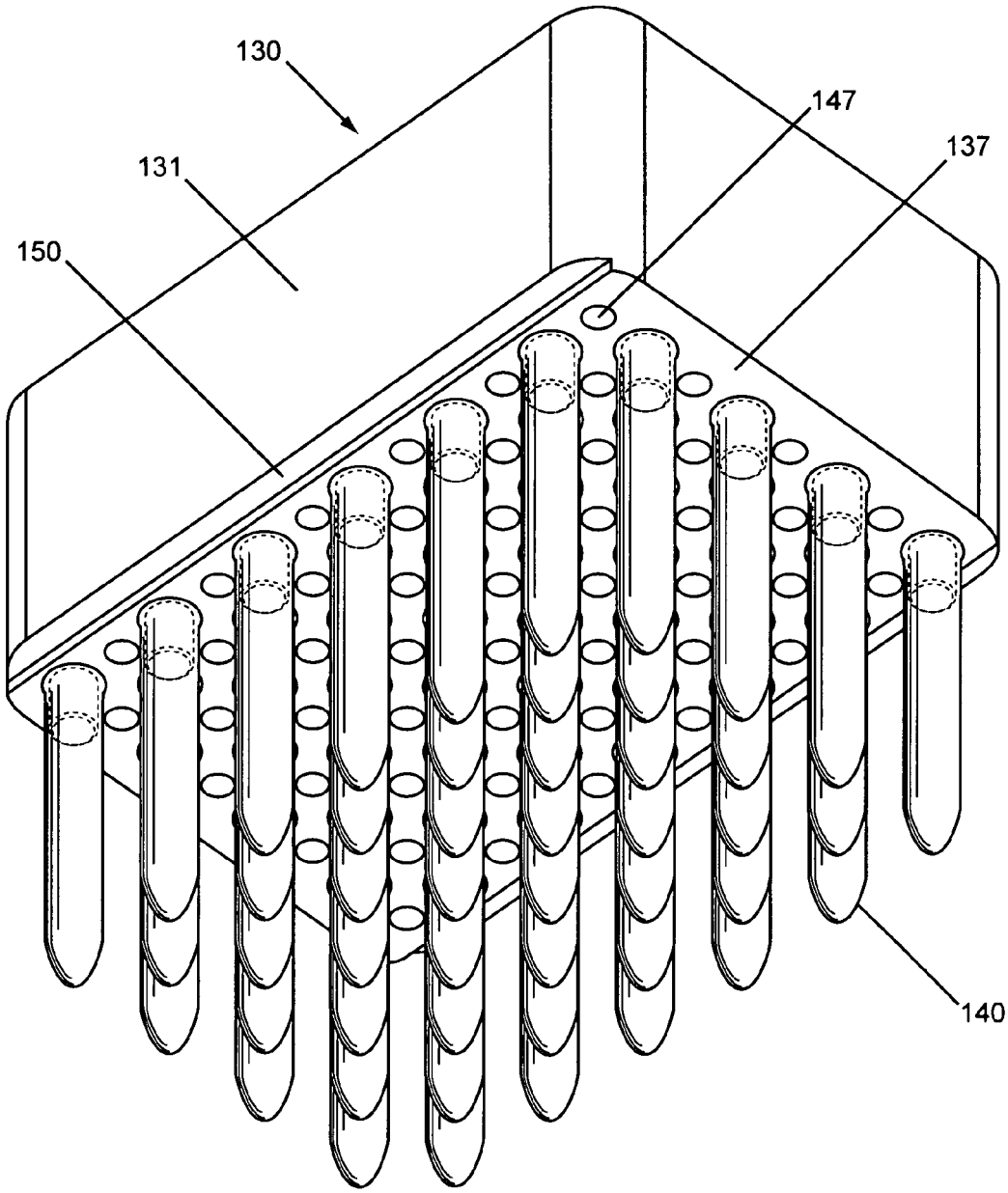
FIG. 20 is a bottom view of a capacity altering device.
Figure 21:
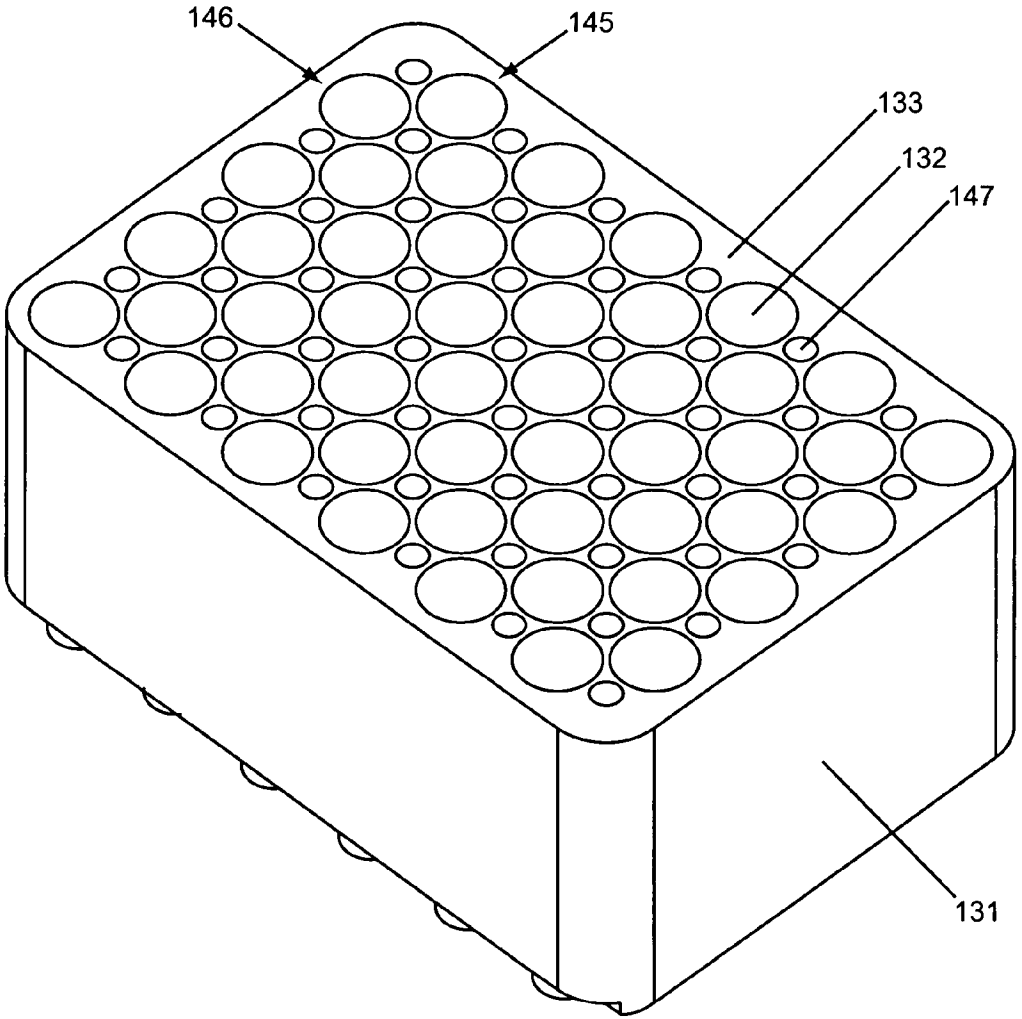
FIG. 21 is a top view of the body structure of the capacity altering device of FIG. 20.
Figure 22:
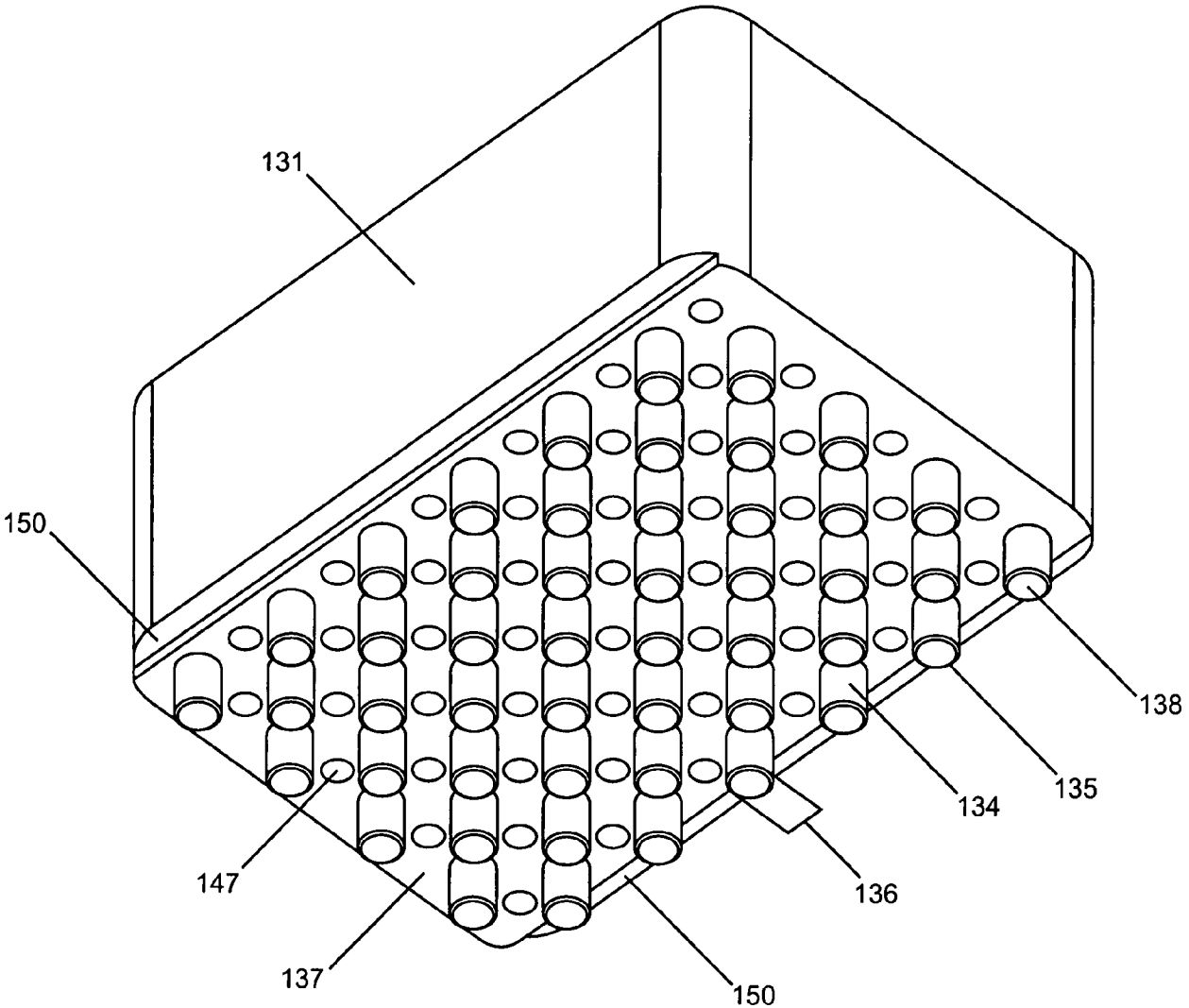
FIG. 22 is a bottom view of the body structure of the capacity altering device of FIG. 20.
Figure 23:
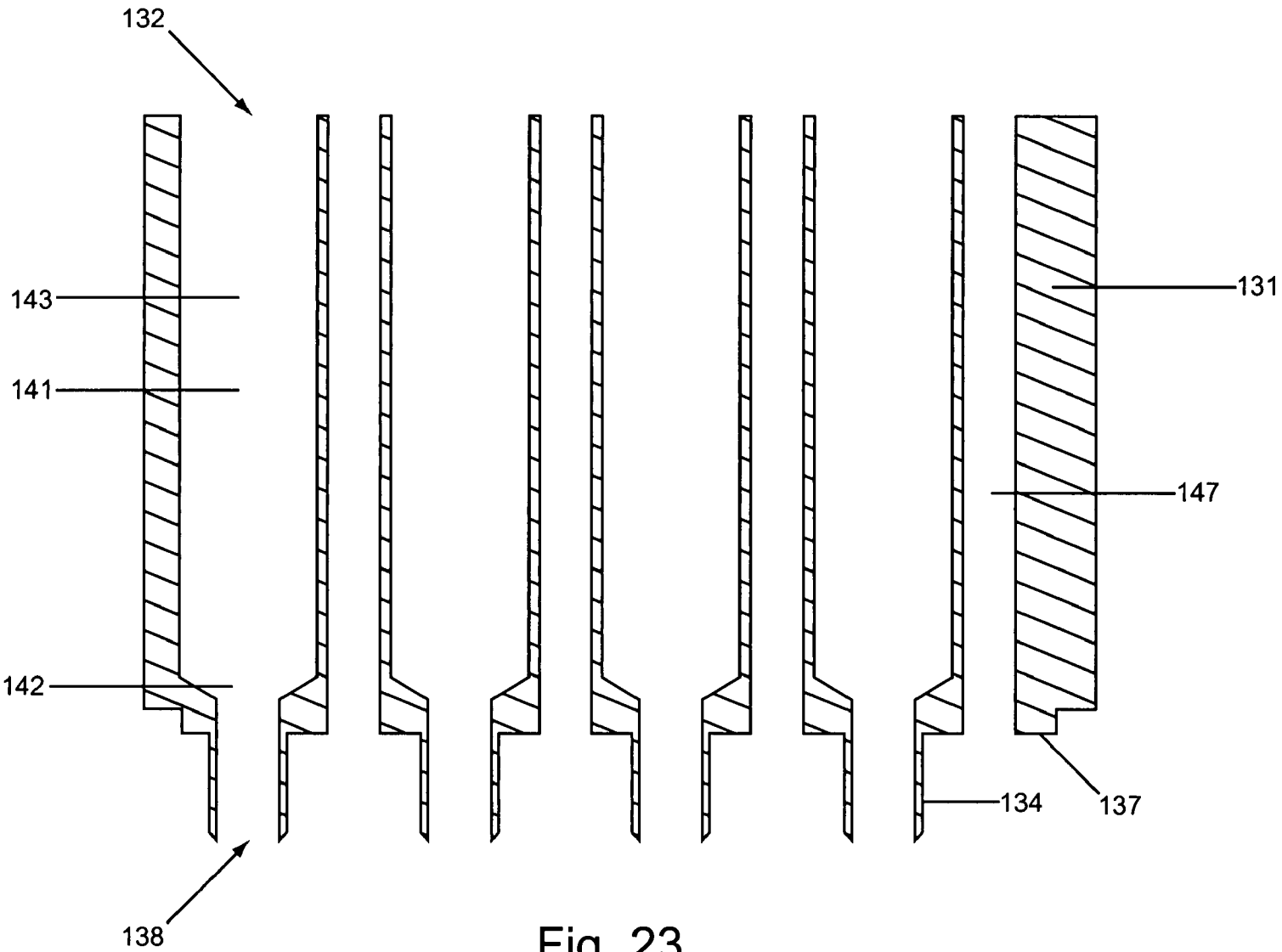
FIG. 23 is a cross-section of the body structure of the capacity altering device of FIG. 20.
Figure 24:
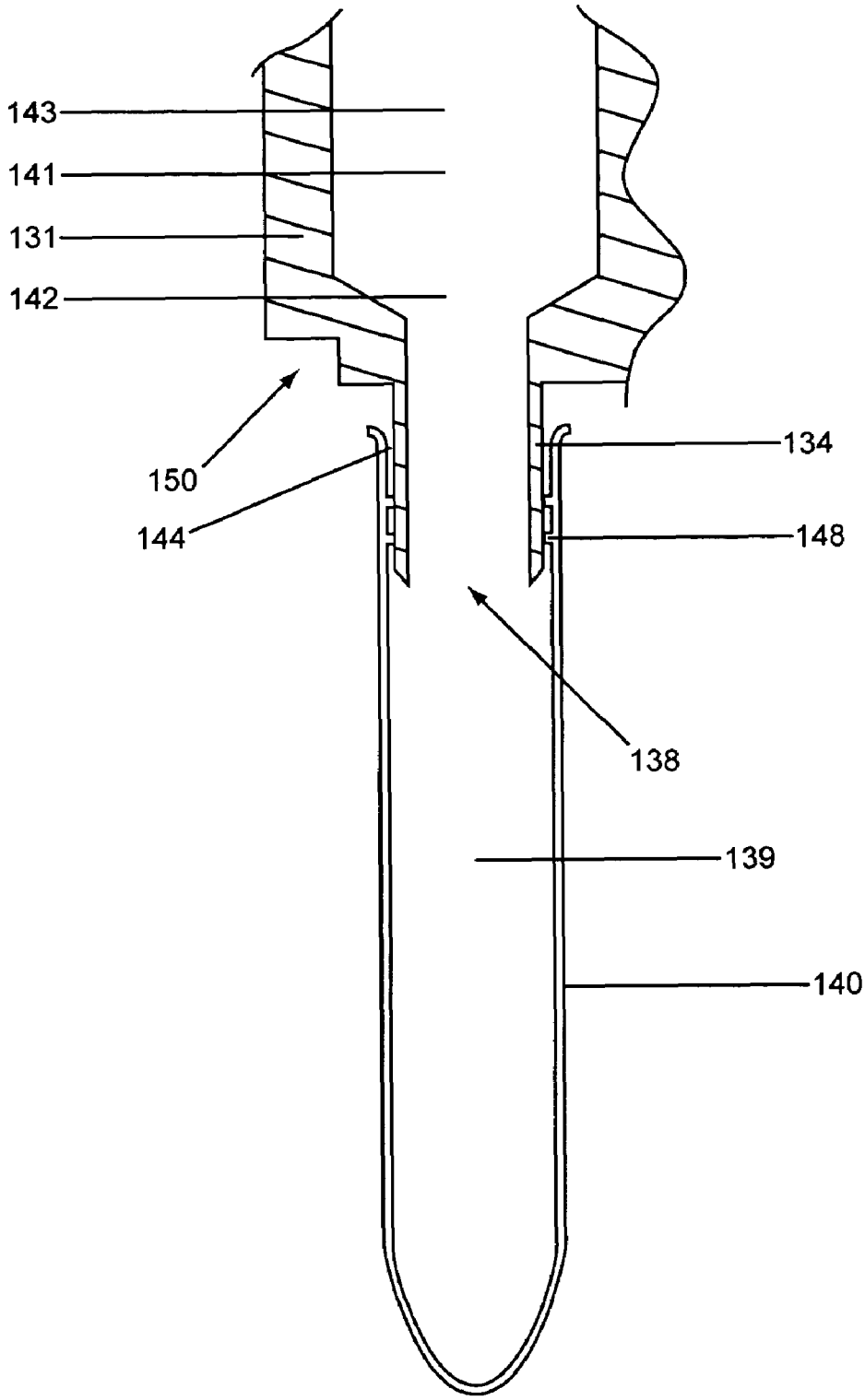
FIG. 24 is a cross-section of a portion of the capacity altering device of FIG. 20.

One class of example embodiments is illustrated in FIGS. 13-19. In this class of embodiments, holder 70 comprises base 71, top plate 72 comprising, e.g., forty-eight apertures 73, and a coupling mechanism comprising three partial side walls 74. Side walls 74 permanently couple top plate 72 to base 71 in a first fixed position. As depicted, screws 75 (e.g., stainless steel screws) attach each side wall 74 to base 71 and top plate 72. Holder 70 in the first fixed position is configured to be inserted in a centrifuge carrier; e.g., as shown in FIG. 16, two holders 70 with capacity altering devices 77 can be positioned in carrier 101, which as depicted is a carrier that fits on a Gold H rotor for a ThermoSavant Discovery SpeedVac (www.thermo.com). Body structure 81 with extensions 90 and sample tubes 78 comprise capacity altering device 77. In this class of embodiments, holder 70 contains, e.g., forty-eight sample tubes 78 that comprise forty-eight external processing regions 79. (As depicted, holder 70 contains an additional forty-eight unused sample tubes 78.) Body structure 81 is disposed on top plate 72, such that top plate 72 is between body structure 81 and sample tubes 78. As depicted, body structure 81 is in contact with top plate 72, and top plate 72 is in contact with sample tubes 78, but this need not be the case in other embodiments. Body structure 81 comprises forty-eight first access apertures 82, forty-eight inner cavities 84 comprising internal processing regions 85, and forty-eight second access apertures 83. As depicted, body structure 81 comprises, e.g., forty-eight cavities 89, which decrease the weight of body structure 81 but which need not be present in other embodiments. Body structure 81 is removably sealed with, e.g., forty-eight sample tubes 78 such that internal processing regions 85 are removably sealed to external processing regions 79. The forty-eight apertures 73 in the top plate are spatially arranged (in twelve staggered columns 92 of four apertures 73 and eight rows 93 of six apertures 73) to correspond to the positions of second access apertures 83. Sample tubes 78 are positioned in tube rack 94. As shown, tube rack 94 has ninety-six apertures 98 in top surface 95 (arranged in 12 columns 96 and eight rows 97, corresponding to the wells of a ninety-six well multiwell plate), although only alternate tubes are accessible through apertures 73 in top plate 72. Tube rack 94 and sample tubes 78 can, e.g., be purchased from Matrix Technologies Corp. (www.matrixtechcorp.com, ScreenMates 1.4 mL deep well tubes in rack). Body structure 81 is removably sealed to sample tubes 78 by forty-eight extensions 90 projecting from bottom surface 87 of body structure 81 through apertures 73. Extensions 90 form pressed, radial seals with sample tubes 78. Sample tubes 78 as purchased from Matrix Technologies Corp. (www.matrixtechcorp.com, ScreenMates 1.4 mL deep well tubes in rack) each comprise two radial protrusions 80 that form removable seals with extensions 90. Tubes lacking such protrusions can also be used. The diameter of apertures 73 in top plate 72 is less than the outer diameter of the top of sample tubes 78. Body structure 81 can thus be, e.g., lifted up off holder 70, e.g., by inserting a small pry bar (e.g., a screwdriver) into groove 88 and prying body structure 81 off holder 70, to detach extensions 90 from sample tubes 78, thereby uncoupling internal processing regions 85 from external processing regions 79, while sample tubes 78 are retained in holder 70. Handling of sample tubes 78 is thus minimized. As depicted, holder 70 comprises door 100, which can be opened as shown in FIG. 14 to allow sample tubes 78 and tube rack 94 to be positioned in or removed from holder 70, or closed as shown in FIG. 13 to secure tube rack 94 in holder 70. Holder 70 need not comprise a door, since tube rack 94 can be secured in holder 70 merely by coupling body structure 81 with sample tubes 78. As depicted in this class of example embodiments, base 71 comprises rectangular aperture 76. The presence of aperture 76 decreases the weight of holder 70, but is not necessary; thus, in other embodiments, the base of the holder is, e.g., solid or comprises more than one aperture. Tube rack 94 as purchased from Matrix Technologies Corp. comprises ninety-six apertures 103 in its bottom surface 104. Removably sealing body structure 81 with sample tubes 78 can involve the exertion of force (e.g., of about 50 pounds) on body structure 81 and sample tubes 78; in some instances, this force can be sufficient to displace tubes 78 through apertures 103. Temporary placement of, e.g., loading support platform 102 under holder 70 prior to sealing body structure 81 to sample tubes 78 can prevent such displacement of tubes 78. As depicted in FIG. 19, sample tubes 78 rest on raised portion 105 of loading support platform 102, which raised portion 105 projects upward into aperture 76 in base 71 of holder 70.

Holder for Use in Centrifuge

One class of embodiments provides a holder for use in a centrifuge. The holder comprises a base plate, a lid, and a coupling mechanism that couples the base plate to the lid in at least a first fixed position. The base plate, coupling mechanism, and lid are configured such that, when they are in the first fixed position (e.g., closed), the holder can be inserted into a centrifuge carrier and rotated in a centrifuge.

The centrifuge carrier can be, e.g., a rotor (e.g., the holder can be inserted directly into a rotor bucket or placed on a rotor shelf), an adapter configured to be inserted into a rotor (e.g., the holder can be inserted into an adapter that fits in a rotor bucket or onto a rotor shelf), or an adapter configured to be attached to a rotor. The centrifuge can be, e.g., a stand-alone centrifuge or can be attached to or part of additional equipment. For example, the centrifuge can be part of a centrifugal vacuum concentrator (e.g., a SpeedVac). One of skill will recognize that a number of centrifuge rotors (including centrifugal vacuum concentrator rotors) are generally commercially available (e.g., from Kendro Laboratory Products, www.sorvall.com, ThermoSavant, www.thermo-.com, or Genevac, www.genevac.com), and that appropriate modifications (e.g., to the size and shape of the base plate, or the height of the closed holder) can be made to configure the holder for use with various of these rotors.

The coupling mechanism can comprise, e.g., at least one screw, at least one hinge, and/or at least one clamp, wherein the screw, hinge, or clamp attaches to the base plate, the lid, or both. In one embodiment, the coupling mechanism comprises four or more screws that attach the lid to the base plate in the first fixed position.

The holder can be used to hold and optionally to centrifuge various containers, objects, etc. In one class of embodiments, the holder contains at least one capacity altering device. In this class of embodiments, at least one body structure, and one or more structures that collectively comprise a plurality of external processing regions, are disposed between the lid and the base plate of the holder. The at least one body structure comprises a plurality of first access apertures that are connected to and separated from a plurality of second access apertures by a plurality of inner cavities that comprise a plurality of internal processing regions. In embodiments in which the holder contains, e.g., two or more capacity altering devices, each device comprises a body structure comprising a plurality of internal processing regions. The body and the one or more structures are removably sealed with each other, such that the internal processing regions are removably sealed to the external processing regions.

In one embodiment, at least one gasket is disposed between the body structure and the external processing regions. This gasket removably seals the internal processing regions to the external processing regions. In certain embodiments, the gasket comprises a plurality of apertures that are spatially arranged to correspond to the plurality of second access apertures in the body structure. Other means of sealing the internal processing regions to the external processing regions can be used, for example, a seal can be formed through direct contact between the body structure and the one or more structures comprising the external processing regions.

The external processing regions can comprise, e.g., any type of sample container. In one embodiment, the external processing regions comprise a plurality of sample tubes (e.g., test tubes, vials, microcentrifuge tubes, or mini tubes). The sample tubes can optionally be positioned in one or more tube racks. In another embodiment, the external processing regions comprise a plurality of the wells of at least one standard 24, 48, 96, 384, or 1536 well multiwell plate.

The plurality of first access apertures can comprise essentially any desired number (e.g., 2 or more, 8 or more, 12 or more, 24 or more, 48 or more, or 96 or more) and can be arranged in essentially any convenient format. For example, the plurality of first access apertures can comprise 48 apertures spatially arranged to correspond to the arrangement of the wells of a standard 48 well multiwell plate (e.g., the 48 apertures can be arranged in six columns and eight rows). Similarly, the first access apertures can comprise 96 apertures spatially arranged to correspond to the wells of a standard 96 well multiwell plate (e.g., the 96 apertures can be arranged in twelve columns and eight rows), 24 apertures spatially arranged to correspond to the wells of a standard 24 well multiwell plate, 384 apertures spatially arranged to correspond to the wells of a standard 384 well multiwell plate, or 1536 apertures spatially arranged to correspond to the wells of a standard 1536 well multiwell plate. It will be evident that the above refers to the spatial arrangement or layout of the apertures, not their size and/or shape. The first access apertures need not be the same size and/or shape as the mouths of the wells of the multiwell plate. As another example, the first access apertures can be spatially arranged to correspond to a custom design (e.g., an array having any number of rows and/or columns, an array in which adjacent rows and/or columns are offset or staggered with respect to each other, or an array not characterized by rows and/or columns).

The lid can be solid or can comprise one or more third access apertures, each of which allows access to one or more of the first access apertures in a body structure contained in the holder. For example, the lid can comprise one third access aperture that allows access to all the first access apertures in the body structure(s) contained in the holder. As another example, the lid can comprise two third access apertures, each of which allows access to all the first access apertures in one of two body structures contained in the holder. In yet another example, the lid can comprise two or more third access apertures, each of which allows access to a column or row of first access apertures in a body structure contained in the device. In one specific embodiment, the holder contains one body structure having 48 first access apertures in an array having six columns and eight rows, and the lid comprises six third access apertures configured such that each third access aperture permits access to one column of eight first access apertures.

In some embodiments, the holder can further comprise at least one ejection mechanism, located between the body structure and the one or more structures comprising the external processing regions, and configured to detach the body structure from the one or more structures, thereby detaching or uncoupling the internal processing regions from the external processing regions. For example, the ejection mechanism can comprise a flat plate comprising a plurality of apertures, e.g., where the diameter of each aperture is less than the outer diameter of the top of each of a plurality of sample tubes comprising the external processing regions. In this example, the body structure can be lifted out of the holder while the plate retains the sample tubes in the holder, thereby detaching the body structure from the sample tubes.

The base plate optionally comprises one or more mating features that mate with one or more tube racks or one or more multiwell plates. The mating features can be, e.g., any features that reduce or prevent lateral movement of the rack(s) or multiwell plate(s) on the base plate. For example, the base plate can comprise a plurality of protrusions between which the rack(s) or plate(s) fit. In certain embodiments, a surface of the base plate comprises one or more grooves or one or more recesses (e.g., grooves within which the bottom edges of a rack or multiwell plate sit, or a rectangular recess within which the bottom surface of a rack or plate sits).

In certain embodiments, one or more tube racks are mated with the base plate, and each tube rack has a top surface comprising a plurality of apertures spatially arranged to correspond to the wells of a standard 24, 48, 96, 384, or 1536 well multiwell plate or to a custom design (e.g., any number of apertures, in an array having any number of rows and/or columns, an array in which adjacent rows and/or columns are offset or staggered with respect to each other, or an array not characterized by rows and/or columns).

In one embodiment, the holder comprises one or more tube racks mated with the base plate, where each tube rack has a plurality of apertures in its bottom surface, and where the base plate comprises at least one vacuum manifold comprising a plurality of apertures in one of its surfaces. The plurality of apertures in the base plate are spatially arranged to correspond to the plurality of apertures in the bottom of the tube rack(s). The vacuum manifold can be used, for example, to draw one or more structures into contact with the base plate. In one embodiment, the holder comprises a plurality of sample tubes, a gasket, and a body structure comprising a plurality of internal processing regions disposed between the lid and the base plate. In this example, the internal processing regions are removably sealed to the sample tubes by the gasket and pressure applied to the body structure by the lid when the lid, base plate, and coupling mechanism are in the first fixed position (e.g., when the holder is closed). The sample tubes are positioned in the one or more tube racks, and can if desired be drawn into contact with the base plate upon application of a vacuum to the vacuum manifold (e.g., to reduce handling of the tubes by holding them stationary while the gasket and/or body structure is applied to or removed from the tubes).

In one class of embodiments, the base plate comprises at least one vacuum manifold comprising a plurality of apertures disposed therein (e.g., a plurality of apertures in the top surface of the base plate). A vacuum can optionally be applied to this manifold, e.g., to draw the one or more structures comprising the external processing regions into contact with the base plate.

The holder can be fabricated from essentially any convenient material or materials. Materials can be selected on the basis of mechanical strength, solvent resistance, ease of fabrication, or other characteristics, and can include, e.g., a metal (e.g., stainless steel, aluminum, titanium, or the like), a metalloid, a polymer such as a plastic (e.g., an acrylic or an acetal, e.g., Delrin®), a ceramic (e.g., glass), a composite, or a cellulose-based material (e.g., wood). In preferred embodiments, the lid and/or the base plate comprises aluminum (e.g., anodized aluminum), steel (e.g., stainless steel), or an acetal (e.g., Delrin®).

One class of embodiments is illustrated in FIGS. 1-7. In this class of embodiments, holder 25 comprises base plate 1, lid 2, which is rectangular in the depicted embodiment (but which can, of course have alternate shape conformations), and a coupling mechanism comprising four screws 3, one at each corner of lid 2. Each of screws 3 passes through lid 2 and engages one of threaded holes 23 in base plate 1, thereby removably coupling lid 2 to base plate 1 in a first fixed position. Holder 25 in the first fixed position as shown in FIG. 1 is configured to be inserted in a centrifuge carrier (e.g., a carrier that fits on a Gold H rotor for a ThermoSavant Discovery SpeedVac, www.thermo.com). In this example, holder 25 includes body structure 4 comprising forty-eight first access apertures 5 (arranged in six columns 26 and eight rows 27), forty-eight inner cavities 19 comprising internal processing regions 7, and forty-eight second access apertures 6. Internal processing regions 7 are removably sealed to forty-eight sample tubes 10 comprising external processing regions 9, by gasket 13 when pressure is applied to body structure 4, gasket 13, and sample tubes 10 when the holder is closed. Lid 2 comprises six third access apertures 8, each of which allows access to one column 26 of eight first access apertures 5 (e.g., to allow addition of liquid sample 60, e.g., from pipette 64, to one or more of internal processing regions 7). Sample tubes 10 are positioned in tube rack 11. Tube rack 11 comprises ninety-six apertures 12 in top surface 28 (arranged to correspond to the wells of a 96 well plate), and ninety-six apertures 17 in bottom surface 29. As shown, tube rack 11 has ninety-six positions but only contains forty-eight sample tubes 10, in alternate columns 30. Base plate 1 comprises vacuum manifold 24 comprising forty-eight apertures 22 that are spatially arranged to correspond to the utilized apertures 17 in bottom surface 29 of tube rack 11. A vacuum can be applied through vacuum outlet 21. Tube rack 11 is mated to base plate 1 by four grooves 20 in the base plate; bottom rim 18 of tube rack 11 fits into grooves 20.

In one embodiment, holder 25 can be assembled in part from commercially available components or modified versions thereof. Tube rack 11 and sample tubes 10 can be purchased, e.g., from Matrix Technologies Corp. (www.matrixtechcorp.com, ScreenMates 1.4 mL deep well tubes in rack). Body structure 4 can be, e.g., a forty-eight well, 5 mL filter plate purchased from Thomson Instrument Company (www.htslabs.com, part number 399108P). As purchased, the filter plate comprises frits, which can be removed. Optionally, the internal diameter of second access apertures 6 can be increased from their as-purchased size, e.g., by drilling. The gasket can be fabricated by forming apertures 14 (FIG. 4) in alternate columns 61 of protrusions 15 in a 96 well cap mat purchased from Thomson Instrument Company (www.hplc1.com, part number 931920), such that apertures 14 are spatially arranged to correspond to the position of second access apertures 6 in body structure 4. Base plate 1 and lid 2 can be, e.g., machined, e.g., from aluminum.

Holder Comprising Vacuum Manifold

One class of embodiments provides a holder that comprises a base plate, a lid, and a coupling mechanism that couples the base plate to the lid in at least a first fixed position. The lid comprises at least one aperture that permits delivery of one or more samples through the lid when the holder is in the first fixed position (e.g., closed). The base plate comprises at least one vacuum manifold that comprises a plurality of apertures disposed therein.

The coupling mechanism can comprise, e.g., at least one screw, at least one hinge, or at least one clamp, wherein the screw, hinge, or clamp attaches to the base plate, the lid, or both. In one embodiment, the coupling mechanism comprises four or more screws that attach the lid to the base plate in the first fixed position.

In one class of embodiments, the holder contains at least one capacity altering device. In this class of embodiments, at least one body structure, and one or more structures that collectively comprise a plurality of external processing regions, are disposed between the lid and the base plate of the holder. The at least one body structure comprises a plurality of first access apertures that are connected to and separated from a plurality of second access apertures by a plurality of inner cavities that comprise a plurality of internal processing regions. In embodiments in which the holder contains, e.g., two or more capacity altering devices, each device comprises a body structure comprising a plurality of internal processing regions. The body and the one or more structures are removably sealed with each other, such that the internal processing regions are removably sealed to the external processing regions.

In one embodiment, at least one gasket is disposed between the body structure and the external processing regions. This gasket removably seals the internal processing regions to the external processing regions. In certain embodiments, the gasket comprises a plurality of apertures that are spatially arranged to correspond to the plurality of second access apertures in the body structure. Other methods of sealing the internal processing regions to the external processing regions can be used, for example, a seal can be formed through direct contact between the body structure and the one or more structures comprising the external processing regions.

The external processing regions can comprise, e.g., any type of sample container. In one embodiment, the external processing regions comprise a plurality of sample tubes (e.g., test tubes, vials, microcentrifuge tubes, or mini tubes). The sample tubes can optionally be positioned in one or more tube racks. In another embodiment, the external processing regions comprise a plurality of the wells of at least one standard 24, 48, 96, 384, or 1536 well multiwell plate.

The plurality of first access apertures can comprise essentially any desired number (e.g., 2 or more, 8 or more, 12 or more, 24 or more, 48 or more, or 96 or more) and can be arranged in essentially any convenient format. For example, the plurality of first access apertures can comprise 48 apertures spatially arranged to correspond to the arrangement of the wells of a standard 48 well multiwell plate (e.g., the 48 apertures can be arranged in six columns and eight rows). Similarly, the first access apertures can comprise 96 apertures spatially arranged to correspond to the wells of a standard 96 well multiwell plate (e.g., the 96 apertures can be arranged in twelve columns and eight rows), 24 apertures spatially arranged to correspond to the wells of a standard 24 well multiwell plate, 384 apertures spatially arranged to correspond to the wells of a standard 384 well multiwell plate, or 1536 apertures spatially arranged to correspond to the wells of a standard 1536 well multiwell plate. It will be evident that the above refers to the spatial arrangement or layout of the apertures, not their size and/or shape. The first access apertures need not be the same size and/or shape as the mouths of the wells of the multiwell plate. As another example, the first access apertures can be spatially arranged to correspond to a custom design (e.g., an array having any number of rows and/or columns, an array in which adjacent rows and/or columns are offset or staggered with respect to each other, or an array not characterized by rows and/or columns).

The at least one aperture in the lid can allow access to one or more of the first access apertures in a body structure contained in the holder. For example, the lid can comprise one aperture that allows access to all the first access apertures in the body structure(s) contained in the holder. As another example, the lid can comprise two apertures, each of which allows access to all the first access apertures in one of two body structures contained in the holder. In yet another example, the lid can comprise two or more apertures, each of which allows access to a column or row of first access apertures in a body structure contained in the device. In one specific embodiment, the holder contains one body structure having 48 first access apertures in an array having six columns and eight rows, and the lid comprises six apertures configured such that each aperture in the lid permits access to one column of eight first access apertures.

The base plate optionally comprises one or more mating features that mate with one or more tube racks or one or more multiwell plates. The mating features can be, e.g., any features that reduce or prevent lateral movement of the rack(s) or multiwell plate(s) on the base plate. For example, the base plate can comprise a plurality of protrusions between which the rack(s) or plate(s) fit. In certain embodiments, a surface of the base plate comprises one or more grooves or one or more recesses (e.g., grooves within which the bottom edges of a rack or multiwell plate sit, or a rectangular recess within which the bottom surface of a rack or plate sits).

In one class of embodiments, one or more tube racks are mated with the base plate, and each tube rack has a top surface comprising a plurality of apertures spatially arranged to correspond to the wells of a standard 24, 48, 96, 384, or 1536 well multiwell plate or to a custom design (e.g., any number of apertures, in an array having any number of rows and/or columns, an array in which adjacent rows and/or columns are offset or staggered with respect to each other, or an array not characterized by rows and/or columns).

In certain embodiments, one or more tube racks are mated with the base plate, and each tube rack has a plurality of apertures in its bottom surface that are spatially arranged to correspond to the plurality of apertures that comprise the vacuum manifold in the base plate. The vacuum manifold can be used, for example, to draw one or more structures into contact with the base plate. In one embodiment, the holder comprises a plurality of sample tubes, a gasket, and a body structure comprising a plurality of internal processing regions disposed between the lid and the base plate. In this example, the internal processing regions are removably sealed to the sample tubes by the gasket and pressure applied to the body structure by the lid when the lid, base plate, and coupling mechanism are in the first fixed position (e.g., when the holder is closed). The sample tubes are positioned in the one or more tube racks, and can if desired be drawn into contact with the base plate upon application of a vacuum to the vacuum manifold (e.g., to reduce handling of the tubes by holding them stationary while the gasket and/or body structure is applied to or removed from the tubes).

The holder can be fabricated from essentially any convenient material or materials. Materials can be selected on the basis of mechanical strength, solvent resistance, ease of fabrication, or other characteristics, and can include, e.g., a metal (e.g., stainless steel, aluminum, titanium, or the like), a metalloid, a polymer such as a plastic (e.g., an acetal or an acrylic), a ceramic (e.g., glass), a composite, or a cellulose-based material (e.g., wood). In preferred embodiments, the lid and/or the base plate comprises aluminum (e.g., anodized aluminum), steel (e.g., stainless steel), or an acetal.

Capacity Altering Device

One aspect of the present invention provides a device that can be used to temporarily alter (typically increase) the capacity of external processing regions (e.g., sample containers, bottles, vials, sample tubes, or the wells of a multiwell plate). The capacity altering device comprises at least one body structure, a plurality of external processing regions, and at least one sealing mechanism. The body structure comprises a plurality of first access apertures connected to, and separated from, a plurality of second access apertures by a plurality of inner cavities, the inner cavities comprising a plurality of internal processing regions. Each of the internal processing regions has a first capacity, and each of the external processing regions has a second capacity. The sealing mechanism is coupled to or configured to be coupled to the body structure, and is configured to removably seal the plurality of internal processing regions with the plurality of external processing regions.

Removably sealing the internal processing regions and the external processing regions can form a plurality of combined processing regions, which can contain one or more samples (e.g., a liquid sample, a liquid or solid entrained in a gas (e.g., an aerosol), a powdered solid, or a paste). The present invention is particularly useful in instances where the volume of at least one of the samples is greater than the second capacity of the external processing regions. As another example, the invention is useful in instances where the required working volume (e.g., volume available for gas expansion) for at least one of the samples is greater than the second capacity of the external processing regions.

There are typically, but not necessarily, an equal number of first access apertures, second access apertures, and inner cavities in the body structure. The first access apertures can be, e.g., located in a top surface of the at least one body structure, and the second access apertures can be, e.g., located on or near a bottom surface of the body structure. The first access apertures can have essentially any convenient shape; e.g., they can be oblong, rectangular, circular, etc. The first access apertures and the second access apertures need not have the same shape and/or size. Maximizing the size of the first and/or second access apertures can in some embodiments be advantageous, for example, to increase the rate at which liquid flows from the internal processing regions to the external processing regions or the rate at which liquid evaporates from the internal and/or external processing regions.

In one embodiment, each of the inner cavities comprises at least one angled region (e.g., a section of wall defining the inner cavity is angled relative to a major axis of the cavity). The angled region facilitates a flow of one or more volumes of liquid from the inner cavity to one of the external processing regions.

The first capacity of the internal processing regions can be less than, equal to, or, typically, greater than the second capacity of the external processing regions. The first capacity can be essentially any desired volume; for example, the first capacity can be at least about 1 mL, at least about 2 ml, at least about 3 mL, at least about 5 mL, or at least about 10 mL.

The plurality of first access apertures can comprise essentially any desired number (e.g., 2 or more, 8 or more, 12 or more, 24 or more, 48 or more, or 96 or more) and can be arranged in essentially any convenient format. For example, the plurality of first access apertures can comprise 48 apertures spatially arranged to correspond to the arrangement of the wells of a standard 48 well multiwell plate (e.g., the 48 apertures can be arranged in six columns and eight rows). Similarly, the first access apertures can comprise 96 apertures spatially arranged to correspond to the wells of a standard 96 well multiwell plate (e.g., the 96 apertures can be arranged in twelve columns and eight rows), 24 apertures spatially arranged to correspond to the wells of a standard 24 well multiwell plate, 384 apertures spatially arranged to correspond to the wells of a standard 384 well multiwell plate, or 1536 apertures spatially arranged to correspond to the wells of a standard 1536 well multiwell plate. It will be evident that the above refers to the spatial arrangement or layout of the apertures, not their size and/or shape. The first access apertures need not be the same size and/or shape as the mouths of the wells of the multiwell plate. As another example, the first access apertures can be spatially arranged to correspond to a custom design (e.g., an array having any number of rows and/or columns, an array in which adjacent rows and/or columns are offset or staggered with respect to each other, or an array not characterized by rows and/or columns).

The external processing regions can comprise, e.g., any type of sample containers. In one class of embodiments, the plurality of internal processing regions is removably sealed with a plurality of sample containers comprising the external processing regions. In one embodiment, the sample containers comprise sample tubes (e.g., test tubes, vials, microcentrifuge tubes, or mini tubes). The sample tubes can be axially aligned with the inner cavities. The sample tubes need not be so aligned; for example, the long axis of each sample tube can be parallel to but not aligned with the axis of the inner cavity, e.g., where each second access aperture is not located in the center of the inner cavity. The sample tubes can optionally be positioned in at least one tube rack. The tube rack can, for example, comprise a plurality of apertures (e.g., in a top surface) spatially arranged to correspond to wells of a standard 24, 48, 96, 384, or 1536 well multiwell plate, or to a custom design (e.g., an array having any number of rows and/or columns, an array in which adjacent rows and/or columns are offset or staggered with respect to each other, or an array not characterized by rows and/or columns).

In another embodiment, the plurality of internal processing regions is removably sealed with the plurality of external processing regions, and the external processing regions comprise a plurality of wells of a standard 24 well, 48 well, 96 well, 384 well, or 1536 well multiwell plate. Each well can but need not be axially aligned with an inner cavity. The plurality of wells can but need not comprise the totality of wells on the multiwell plate. As one example, a body structure comprising 48 internal processing regions can be removably sealed with 48 of the wells of a 96 well multiwell plate (e.g., with alternate columns of wells).

The body structure can be fabricated (e.g., molded or machined) from essentially any convenient material. Materials can be chosen, e.g., for low binding of sample components, to resist a solvent, acid, or base, and/or to promote efficient heat transfer, among other considerations. The body structure can comprise, e.g., an acetal (e.g., Delrin®), a fluoropolymer (e.g., polytetrafluoroethylene, Teflon®), polypropylene, polycarbonate, polyketone, acrylic, or a metal (e.g., steel or anodized aluminum). In certain embodiments, the body structure preferably comprises polypropylene. The body structure can be disposable or reusable.

The sealing mechanism can be, e.g., configured to form one or more removable seals with the external processing regions, and the sealing mechanism can be, e.g., operably coupled to the second access apertures. In one class of embodiments, each of the second access apertures is circular, and the sealing mechanism comprises a plurality of extensions projecting from a bottom surface of the body structure. Each extension has a terminus at which one of the second access apertures is located. The extensions can be, e.g., straight, where the outer diameter of a cross section of each extension is essentially constant along the extension from the body structure to the terminus of the extension. In other embodiments, the extensions are angled extensions, e.g., wherein the outer diameter of a cross-section of each angled extension is greatest near the body structure and least at the terminus of the extension.

A seal can be formed through direct contact between the body structure and the external processing regions. For example, in one class of embodiments, each external processing region comprises a circular aperture, and extensions from the body structure form one or more pressed seals (e.g., radial seals or fitted cylindrical seals, involving friction) with the external processing regions. In another class of example embodiments (e.g., for use with supercritical fluid chromatography, where vessel(s) used to collect fractions must withstand gas expansion), the sealing mechanism comprises threads onto which the external processing regions can be screwed. For example, threaded vials comprising the external processing regions can be screwed into the body structure or onto extensions projecting from a bottom surface of the body structure.

In other embodiments, direct contact is not made between the body structure and the external processing regions; e.g., the sealing mechanism can further comprise at least one gasket located between extensions from the body structure and the external processing regions.

In one class of embodiments, the at least one sealing mechanism comprises at least one gasket. The gasket can, e.g., comprise a plurality of apertures spatially arranged to correspond to the plurality of second access apertures in the body structure. The gasket can be flat or otherwise. In one embodiment, the plurality of external processing regions comprise a plurality of sample tubes, which are arranged in a predetermined array and each of which comprises an aperture, and the gasket comprises a plurality of protrusions, which are spatially arranged to correspond to the array of tubes. Each protrusion is configured to fit in the aperture of one of the sample tubes, thereby removably sealing the gasket with the sample tubes.

The gasket can be, e.g., permanently attached to the body structure or can be removable. The gasket can be disposable or reusable, and can comprise essentially any convenient material. For example, the gasket can comprise silicone, a fluoropolymer, polytetrafluoroethylene, Viton®, or rubber (e.g., buna-n).

The capacity altering device or a portion thereof (e.g., the external processing regions) can optionally be contained in a holder. The holder can, e.g., assist in removably sealing the internal processing regions with the external processing regions (e.g., by applying pressure to the body structure when the holder is closed). The holder can, e.g., be configured to be inserted in a centrifuge carrier as described above. Alternatively or in addition, the holder can be configured for use in one or more other devices, including, but not limited to, a fraction collector, a lyophilizer, or an evaporator, for example, a centrifugal vacuum concentrator (e.g., a SpeedVac), a nitrogen blow-down evaporator (e.g., a TurboVap by Zymark Corporation, www.zymark.com), or an infrared vortex evaporator (e.g., an IR-Dancer® by Brand Tech Scientific, Inc., www.brandtech.com).

In one class of embodiments, the capacity altering device or a portion thereof is contained in a holder that comprises a base plate, a lid, and a coupling mechanism that couples the base plate to the lid in at least a first fixed position. The holder can in some embodiments assist in removably sealing the internal processing regions with the external processing regions (e.g., by applying pressure to the body structure when the holder is closed). The holder can, e.g., be configured to be inserted in a centrifuge carrier as described above. Alternatively or in addition, the holder can be configured for use in one or more other devices (e.g., a fraction collector, lyophilizer, or evaporator). The holder can further comprise, e.g., an ejection mechanism or vacuum manifold.

In another class of embodiments, the capacity altering device or a portion thereof (e.g., the external processing regions) is contained in a holder that comprises a base, a top plate, and a coupling mechanism that couples the base to the top plate in at least a first fixed position. The holder can, e.g., be configured to be inserted in a centrifuge carrier as described above. Alternatively or in addition, the holder can be configured for use in one or more other devices (e.g., a fraction collector, lyophilizer, or evaporator). In other embodiments, the device or a portion thereof is contained in a holder that is configured to be inserted into a centrifuge carrier and rotated in a centrifuge.

Figure 2:
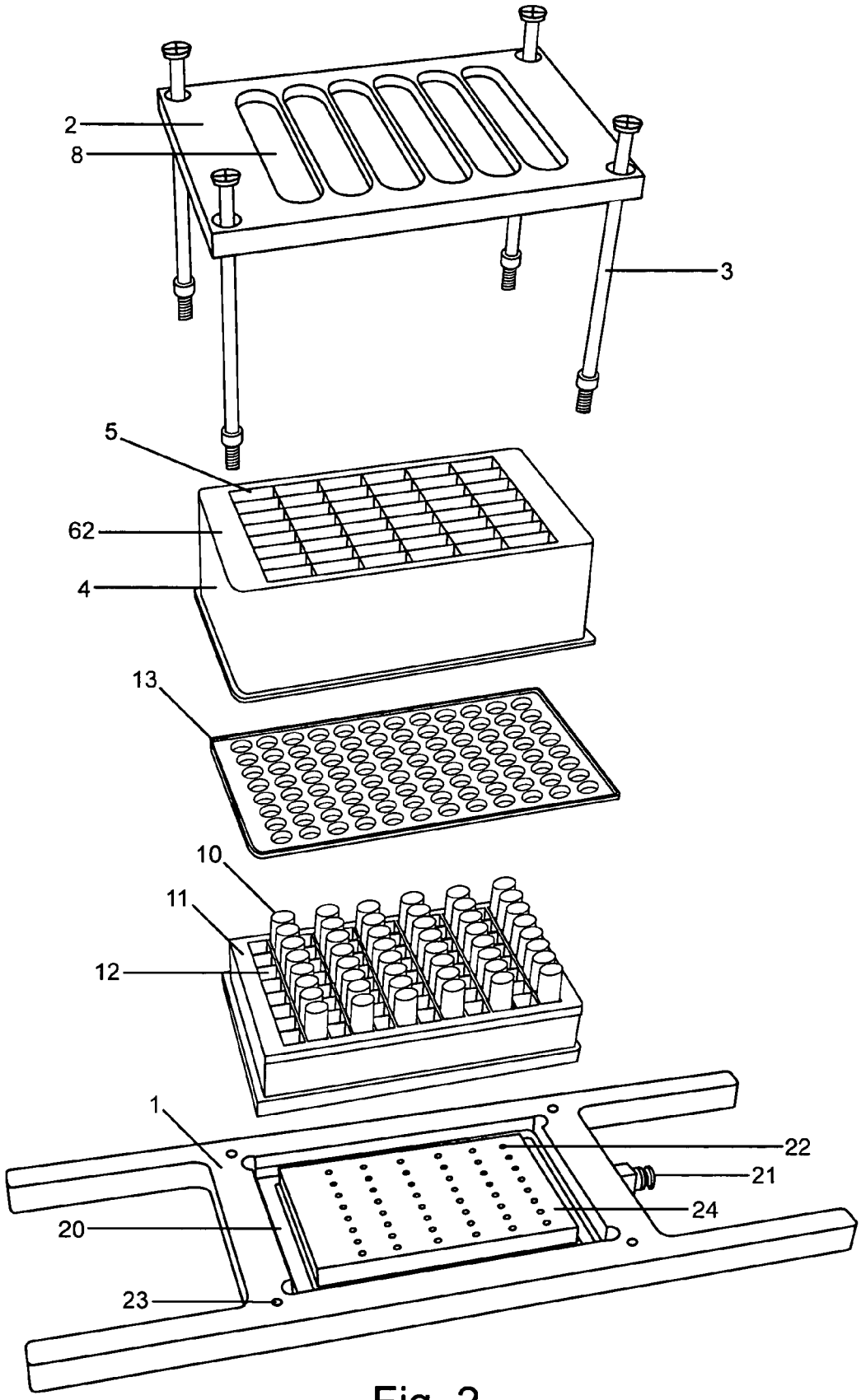
FIG. 2 is an exploded view of the capacity altering device and holder of FIG. 1.
Figure 3:
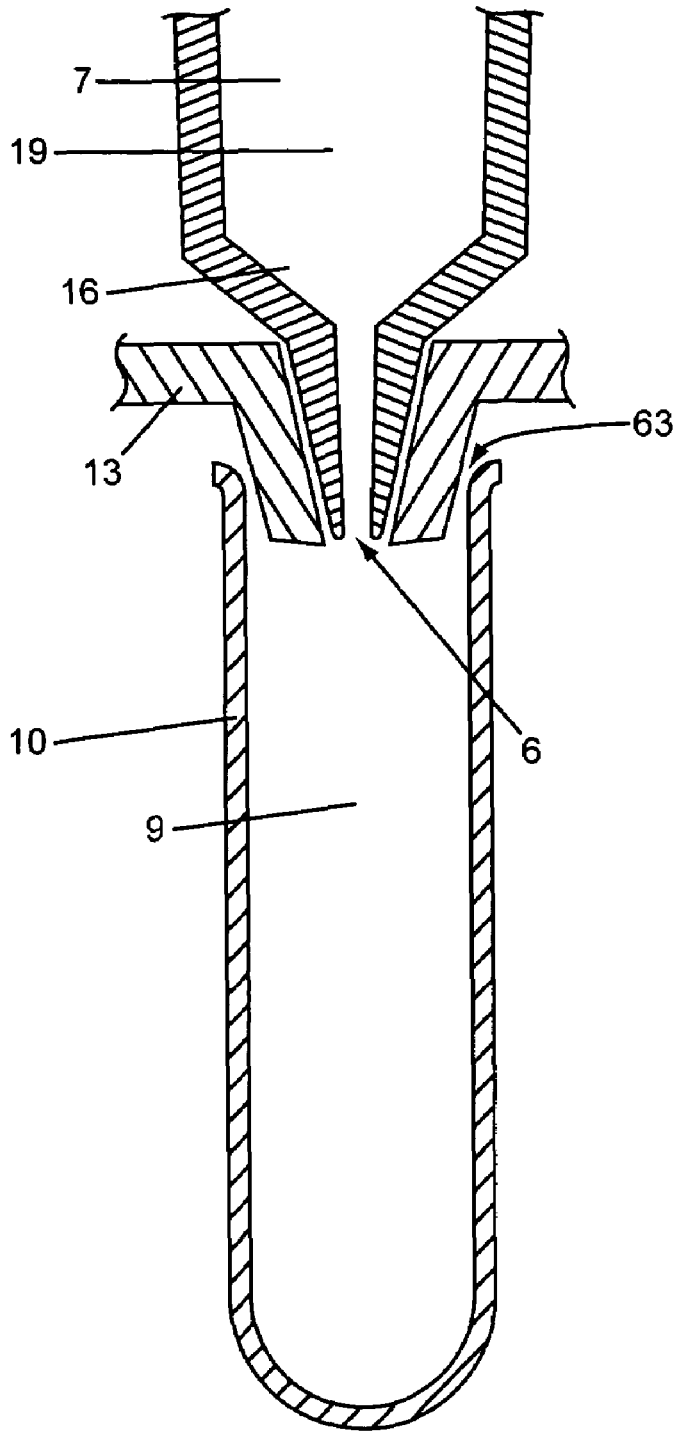
FIG. 3 is a cross-section of a portion of the capacity altering device of FIG. 1.
Figure 4:
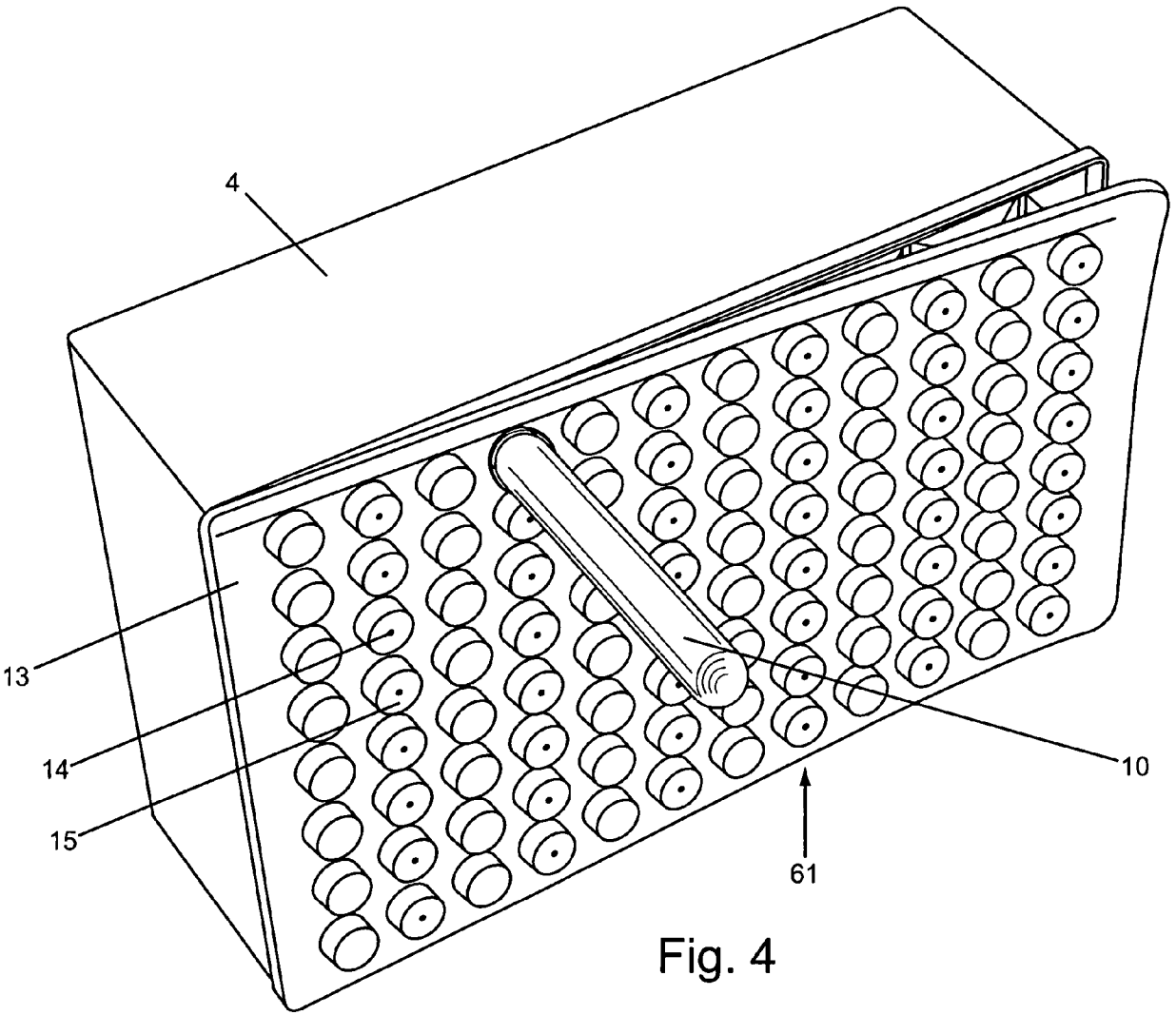
FIG. 4 is a bottom view of the gasket of the capacity altering device of FIG. 1.
Figure 5:
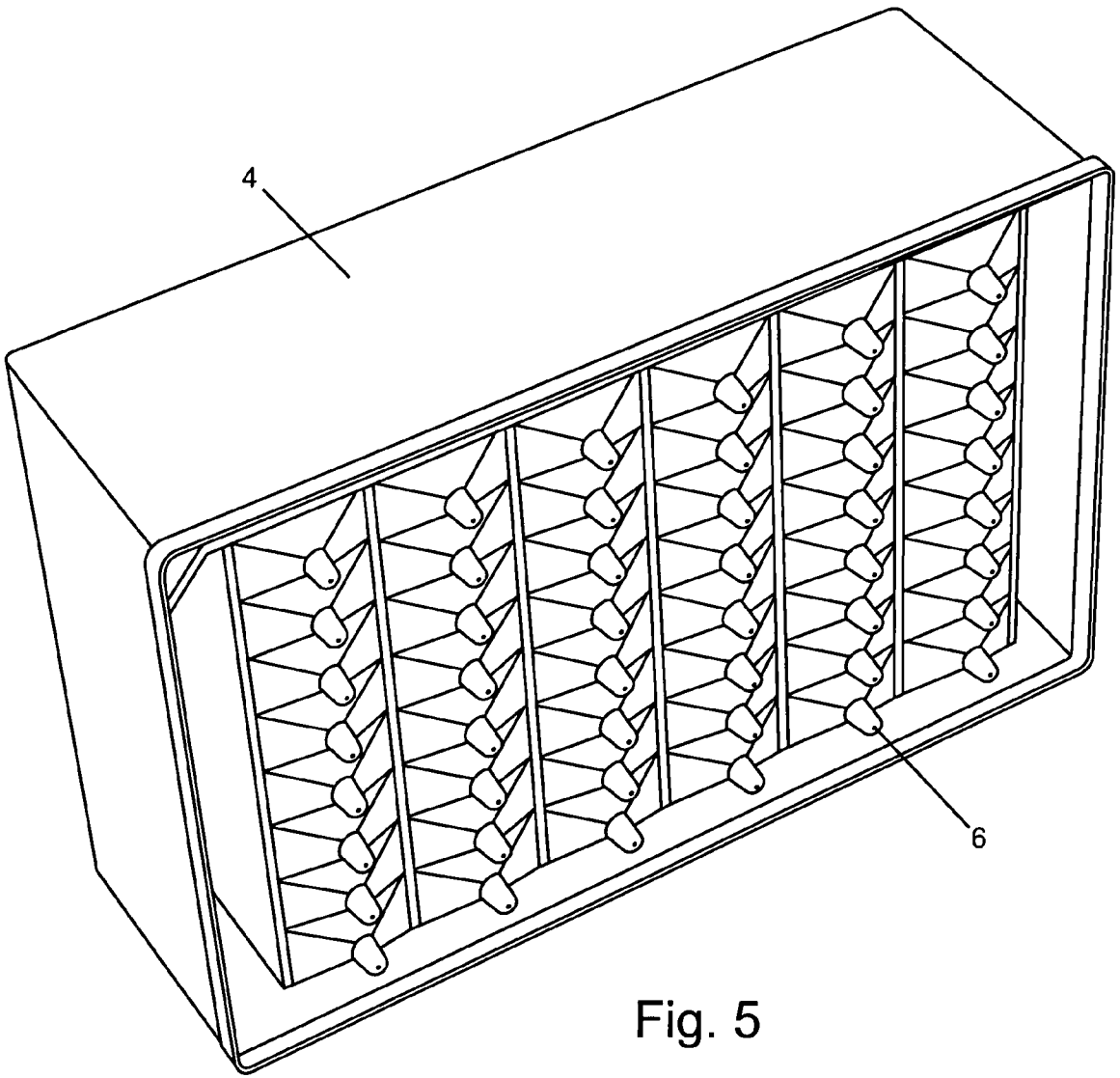
FIG. 5 is a bottom view of the body structure of the capacity altering device of FIG. 1.
Figure 6:
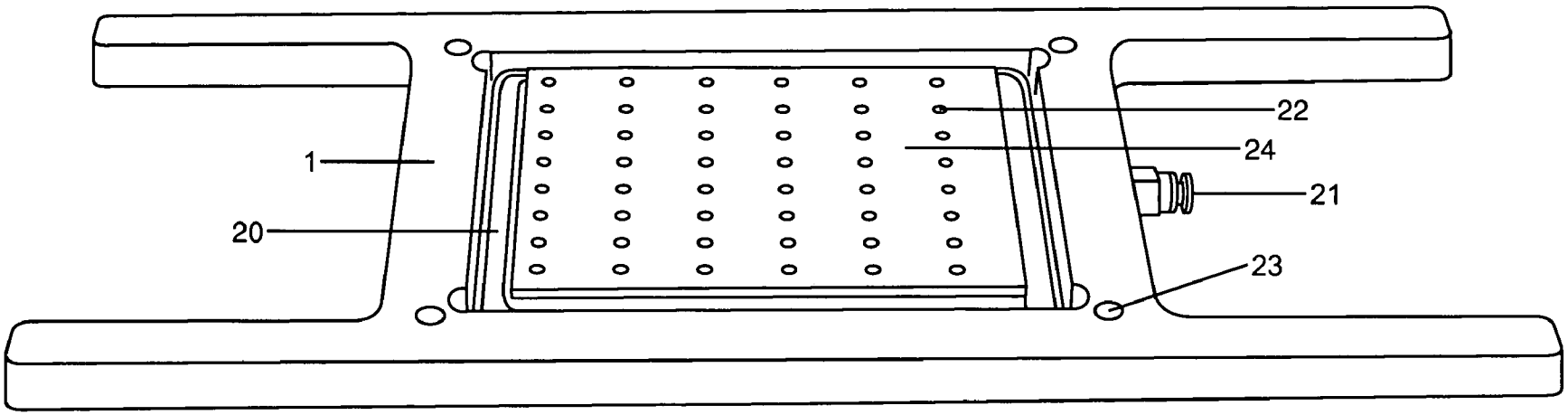
FIG. 6 is a top view of the base plate of the holder of the capacity altering device of FIG. 1.
Figure 7:
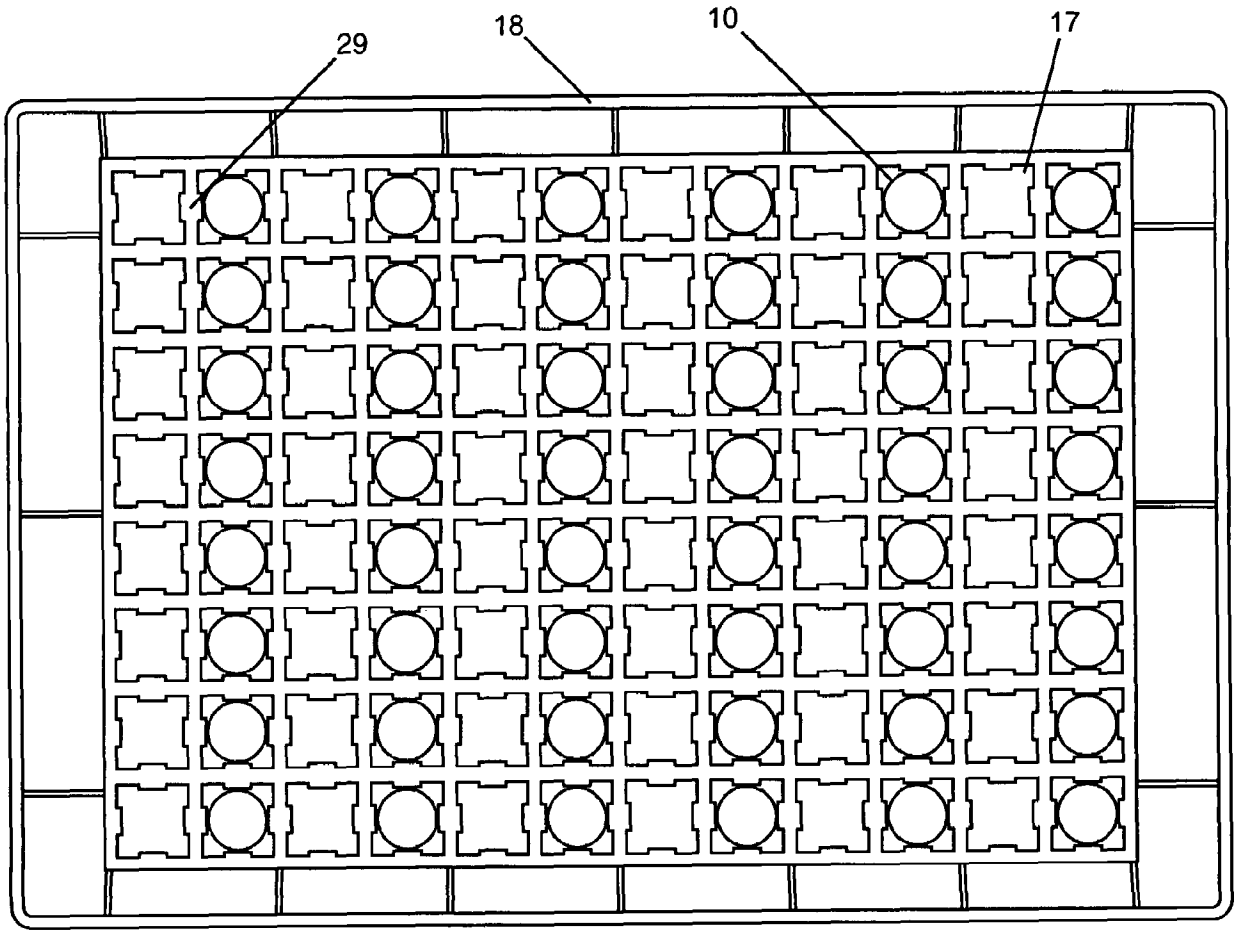
FIG. 7 is a bottom view of the tube rack of the capacity altering device of FIG. 1.
Figure 8:
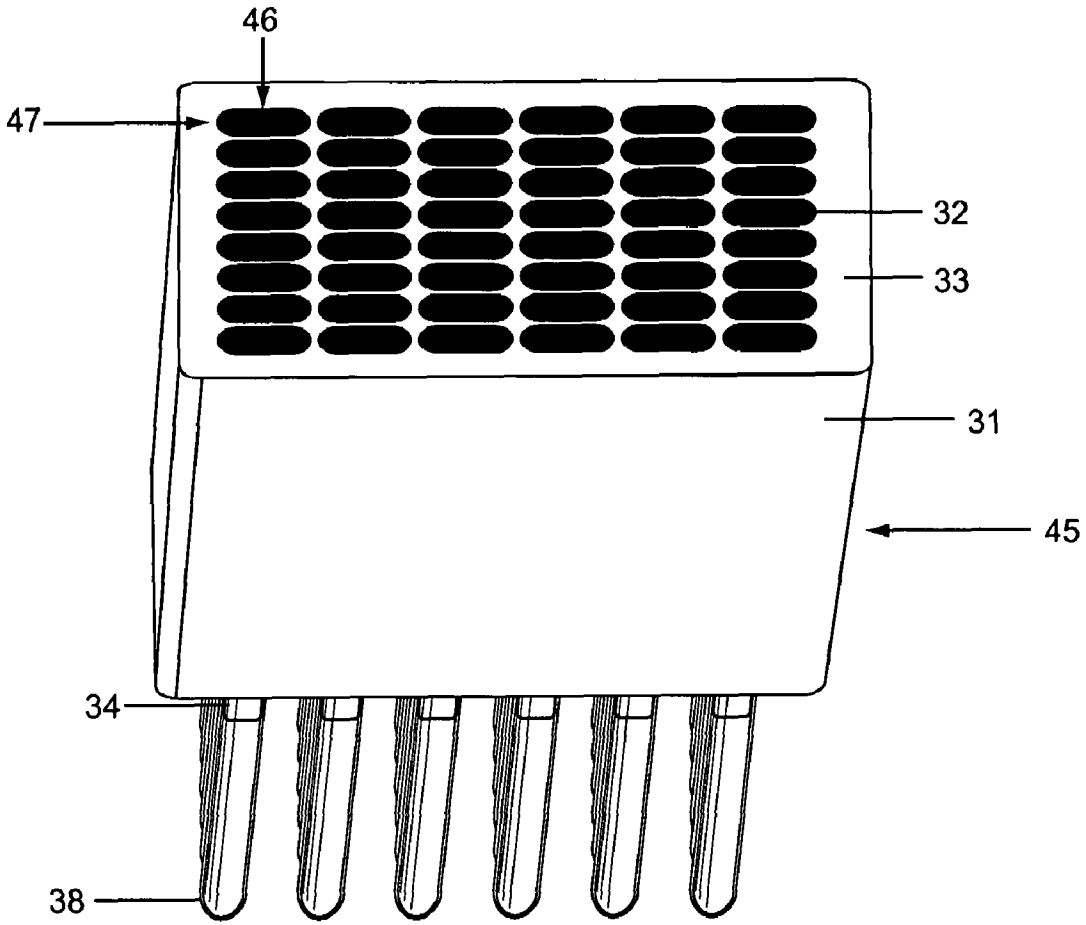
FIG. 8 depicts a capacity altering device.
Figure 9:
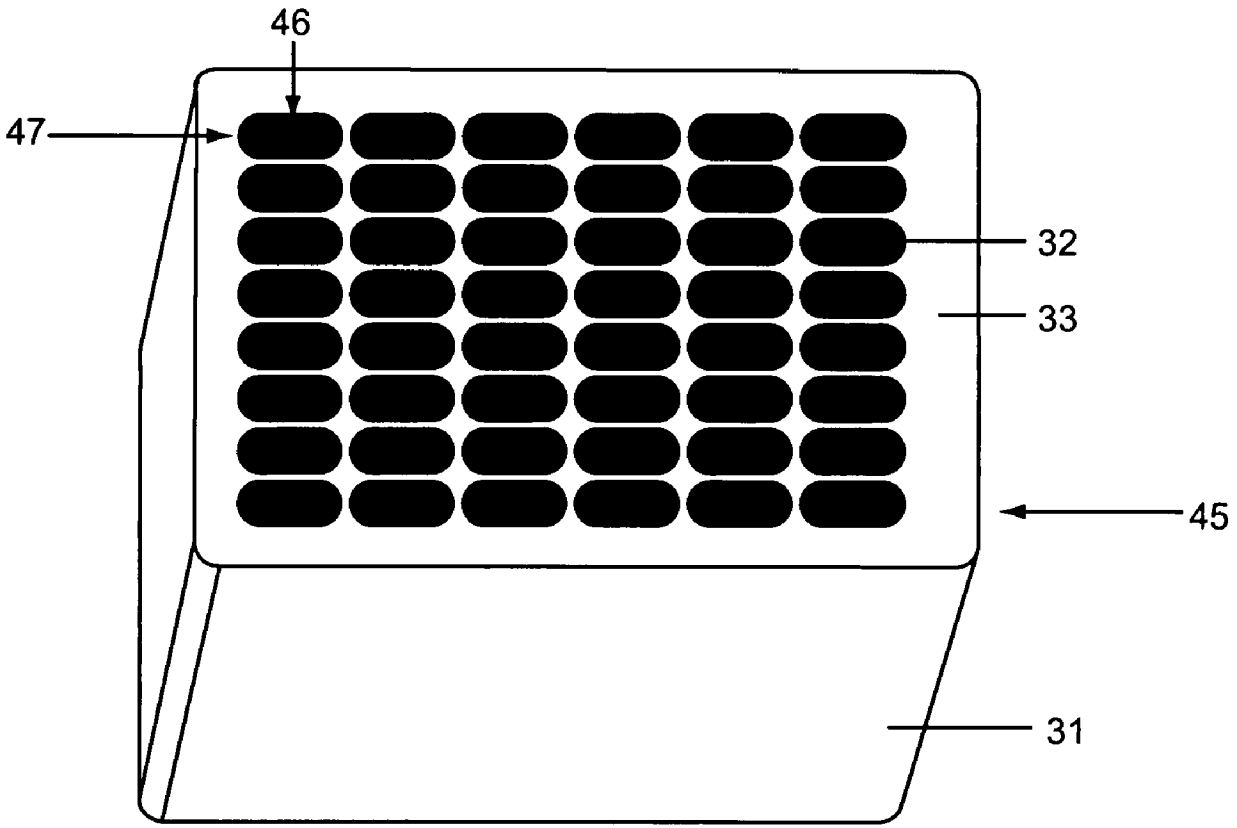
FIG. 9 is a top view of the body structure of the capacity altering device of FIG. 8.
Figure 10:
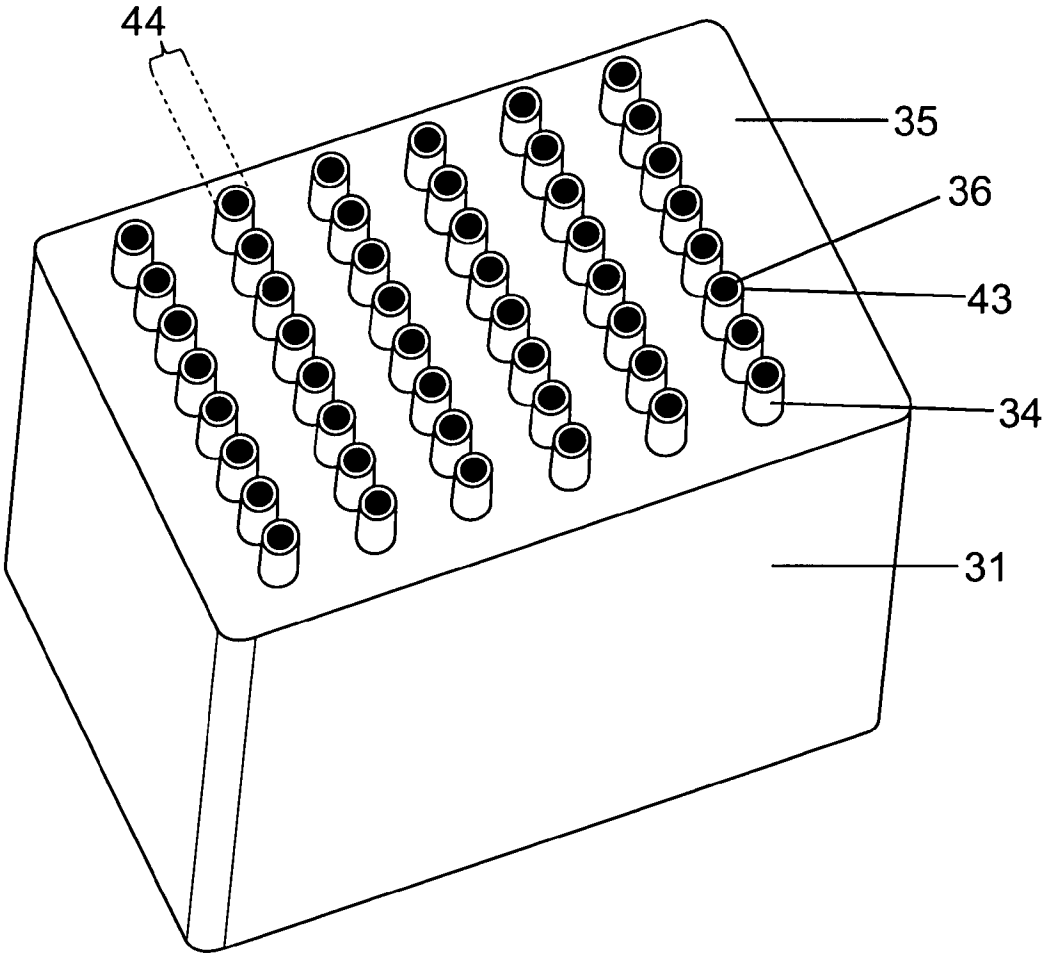
FIG. 10 is a bottom view of the body structure of the capacity altering device of FIG. 8.
Figure 11:
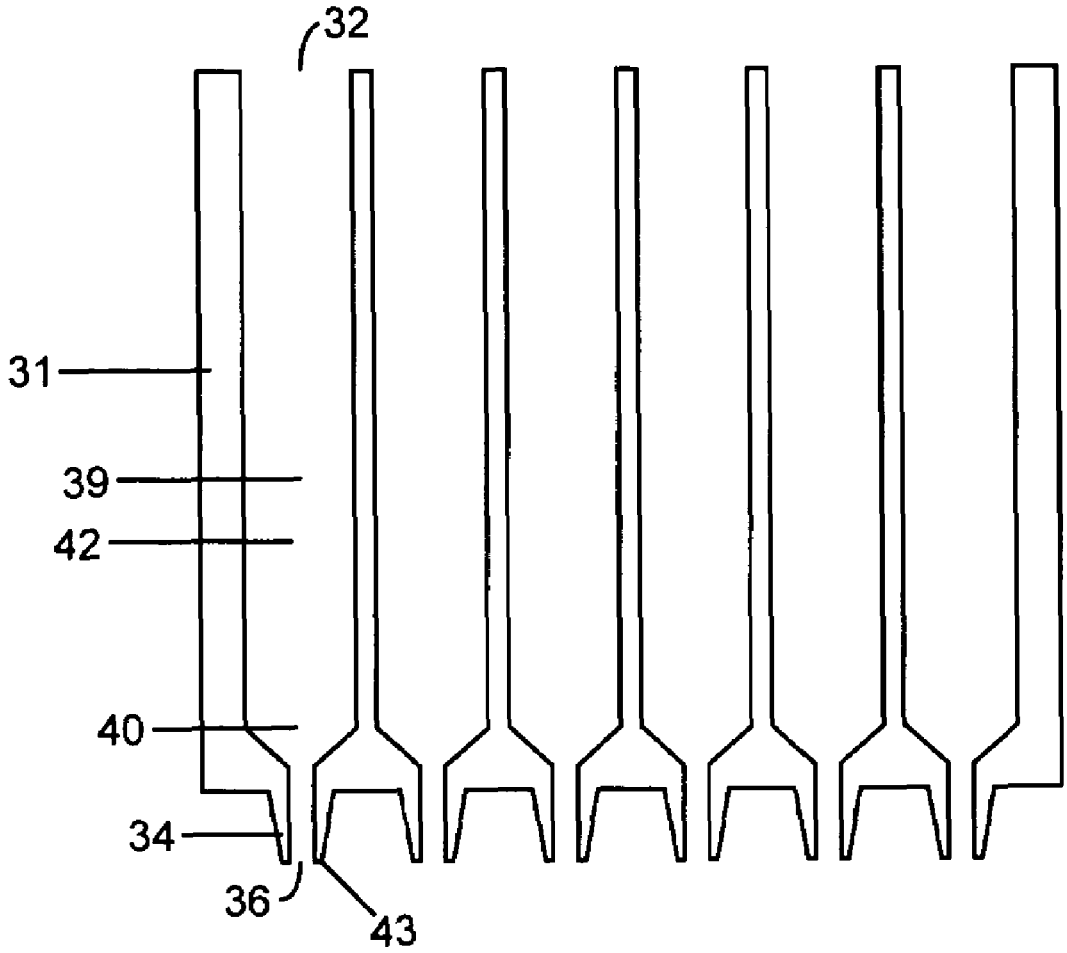
FIG. 11 is a cross-section of the body structure of the capacity altering device of FIG. 8.
Figure 12:
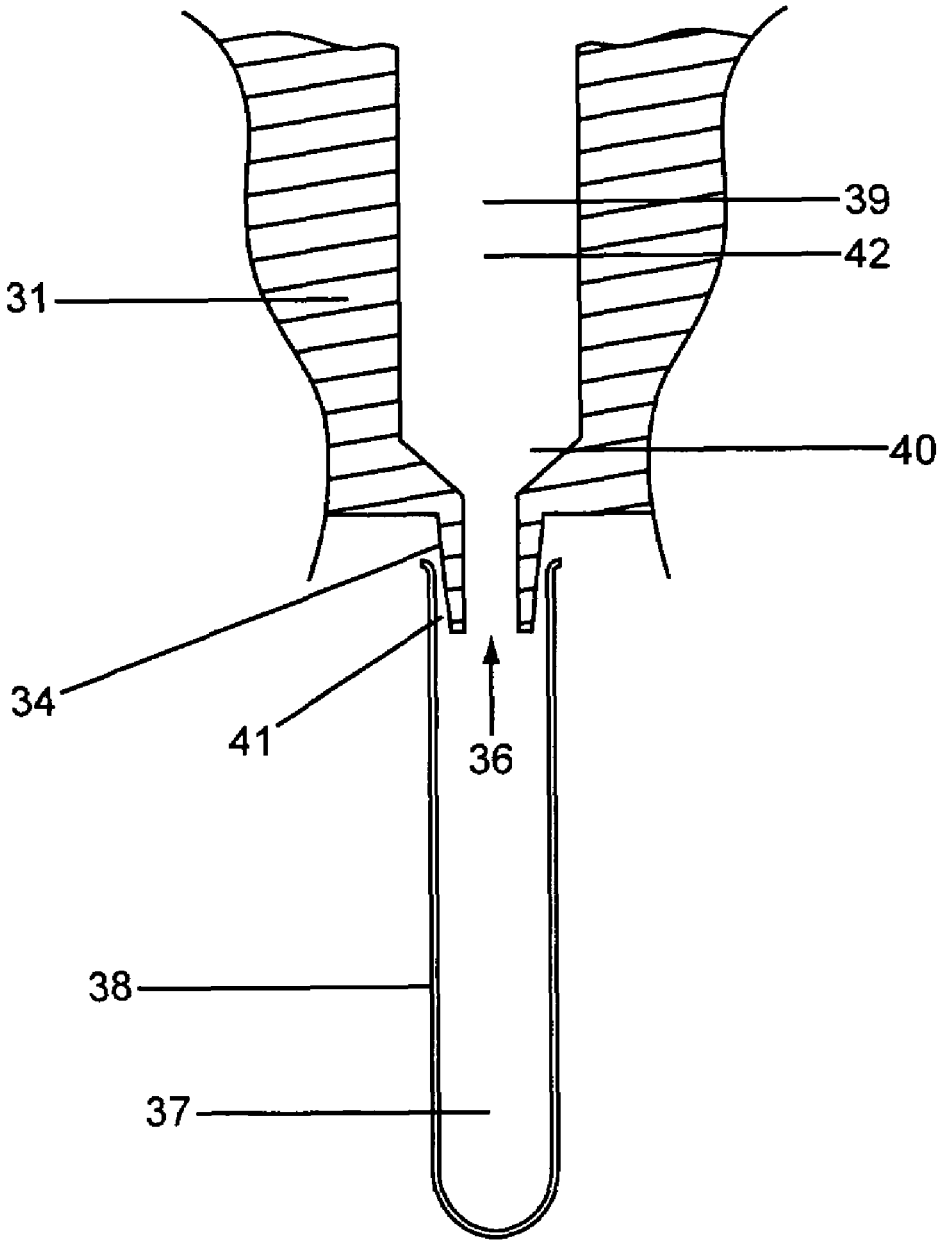
FIG. 12 is a cross-section of a portion of the capacity altering device of FIG. 8.

One class of embodiments is illustrated in FIGS. 1-7. In this class of embodiments, capacity altering device 65 comprises body structure 4, gasket 13, and sample tubes 10 comprising external processing regions 9. Body structure 4 comprises forty-eight first access apertures 5 (arranged in six columns 26 and eight rows 27), forty-eight inner cavities 19 comprising internal processing regions 7, and forty-eight second access apertures 6. Internal processing regions 7 are removably sealed to forty-eight sample tubes 10 comprising external processing regions 9, by gasket 13 when pressure is applied to body structure 4, gasket 13, and sample tubes 10 when the holder is closed. First access apertures 5 are located in top surface 62 of body structure 4. Each of inner cavities 19 comprises angled region 16, which facilitates a flow of one or more volumes of liquid from inner cavity 19 to one of external processing regions 9. Sample tubes 10 are axially aligned with inner cavities 19, and are positioned in tube rack 11. Tube rack 11 comprises ninety-six apertures 12 in top surface 28 (arranged to correspond to the wells of a 96 well plate), and ninety-six apertures 17 in bottom surface 29. As shown, tube rack 11 has ninety-six positions but only contains forty-eight sample tubes 10, in alternate columns 30. Gasket 13 comprises forty-eight apertures 14 in alternate columns 61 of protrusions 15. Protrusions 15 fit in apertures 63 of sample tubes 10. As depicted in FIGS. 1 and 2, device 65 is contained in holder 25, which comprises base plate 1, lid 2, and a coupling mechanism comprising four screws 3 that removably couple lid 2 to base plate 1 in a first fixed position as shown in FIG. 1. One or more samples, e.g., liquid sample 60, can be added, e.g., from pipette 64, to one or more of internal processing regions 7 through third access apertures 8. It will be evident that sample (e.g., depicted liquid sample 60, a liquid or solid entrained in a gas (e.g., an aerosol), a powdered solid, or a paste) can be added from essentially any convenient device, including, but not limited to, depicted pipette 64, a liquid handler robot, a fraction collection system, a chromatography system, tubing (e.g., tubing operably connected to and/or extending through the first access aperture), and the like.

Another class of embodiments is illustrated in FIGS. 8-12. In this class of embodiments, capacity altering device 45 comprises body structure 31, forty-eight sample tubes 38 comprising external processing regions 37; and a sealing mechanism that comprises forty-eight angled extensions 34 projecting from bottom surface 35 of body structure 31. Body structure 31 comprises forty-eight first access apertures 32 (located in top surface 33 of body structure 31 and arranged in six columns 46 and eight rows 47) connected to and separated from forty-eight second access apertures 36 by forty-eight inner cavities 42. Inner cavities 42 comprise forty-eight internal processing regions 39. Each angled extension 34 has terminus 43 at which one of circular second access apertures 36 is located. Outer diameter 44 of a cross-section of each extension 34 is greatest near body structure 31 and least near terminus 43 of the extension. Angled extensions 34 form pressed, radial seals with external processing regions 37 comprising sample tubes 38, each of which comprises circular aperture 41, thereby removably sealing internal processing regions 39 with external processing regions 37. Each of inner cavities 42 comprises angled region 40, which facilitates a flow of one or more volumes of liquid from inner cavity 42 to one of external processing regions 37. Sample tubes 38 are axially aligned with inner cavities 42.

Yet another class of embodiments is illustrated in FIGS. 20-24. In this class of embodiments, capacity altering device 130 comprises body structure 131, forty-eight sample tubes 140 comprising external processing regions 139, and a sealing mechanism that comprises forty-eight straight extensions 134 projecting from bottom surface 137 of body structure 131. Body structure 131 comprises forty-eight first access apertures 132 (located in top surface 133 of body structure 131 and arranged in twelve staggered columns 145 of four first access apertures 132 and eight rows 146 of six first access apertures 132) connected to and separated from forty-eight second access apertures 138 by forty-eight inner cavities 143. Inner cavities 143 comprise forty-eight internal processing regions 141. Each extension 134 has terminus 135 at which one of circular second access apertures 138 is located. Outer diameter 136 of a cross-section of each extension 134 is essentially constant along the extension, from near body structure 131 to terminus 135 of the extension. Extensions 134 form pressed, radial seals with external processing regions 139 comprising sample tubes 140, each of which comprises circular aperture 144, thereby removably sealing internal processing regions 141 with external processing regions 139. Each of inner cavities 143 comprises angled region 142, which facilitates a flow of one or more volumes of liquid from inner cavity 143 to one of external processing regions 139. Sample tubes 140 are axially aligned with inner cavities 143. Sample tubes 140 can, e.g., be purchased from Matrix Technologies Corp. (www.matrixtechcorp.com, ScreenMates 1.4 ml deep well tubes in rack), and as purchased each sample tube 140 comprises two radial protrusions 148 that form removable seals with extensions 134. Tubes lacking such protrusions can also be used. Grooves 150 (depicted as, e.g., a groove running along each of two edges of bottom surface 137 of body structure 131) can facilitate removal of body structure 131 from sample tubes 140 and uncoupling of internal processing regions 141 from external processing regions 139. As depicted, body structure 131 comprises forty-eight cavities 147 parallel to inner cavities 143. Cavities 147 reduce the weight of body structure 131 but need not be present in all embodiments.

Figure 25:
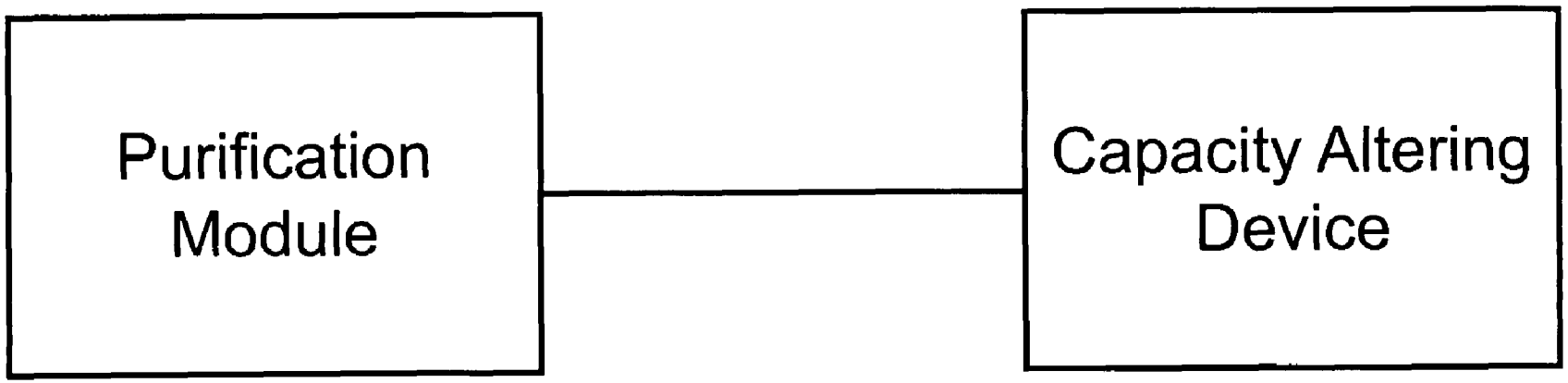
FIG. 25 is a schematic of a system comprising an upstream purification module and a capacity altering device.

In one aspect, the invention includes systems comprising the devices of the invention. In one class of embodiments, shown schematically in FIG. 25, the capacity altering device further comprises at least one upstream purification module that is fluidly connected to the device. For example, the purification module can be fluidly connected to at least one of the combined processing regions formed by removably sealing the internal processing regions with the external processing regions (e.g., the purification module can be fluidly connected to one combined processing region, or to two or more combined processing regions either simultaneously or sequentially). A sample (e.g., a liquid, or a liquid or solid entrained in a gas (e.g., an aerosol)) emerging from the purification module can thus be added to the device (e.g., to at least one of the combined processing regions). The fluid connection can but need not involve a direct physical connection between the purification module and the capacity altering device. As one example, the purification module can be physically connected to the device by tubing; for example, tubing that extends from an outlet of the purification module and that has a terminus operably connected to at least one of the first access apertures. As another example, a sample can simply drip, spray, etc. from an outlet of the purification module, or from tubing extending from such an outlet, into the combined processing region(s) without any direct physical connection or contact having been made between the purification module and the device. For example, the sample can pass through an air gap between the outlet or the terminus of the tubing before it enters the first access aperture, or the tubing can extend through the first access aperture (and optionally through a lid, plug, piercable cover, or the like partially or entirely covering the first access aperture) such that sample exiting the tubing is already inside the combined processing region.

In some embodiments, the purification module comprises a fraction collector; e.g., a fraction collector that automatically directs different volumes of sample emerging from the purification module into different combined processing regions based on, e.g., elapsed time, volume of solvent passed through the purification system, or some form of detection (e.g., mass spectroscopic detection, UV/Vis detection, or the like).

In certain embodiments, the purification module comprises a liquid chromatography column, and preferably comprises a standard preparatory liquid chromatography system. A number of liquid chromatography systems are known in the art, and a number of systems (including standard preparatory liquid chromatography systems) are commerically available. Examples of commercially available LC systems include, but are not limited to, the Waters Delta Prep 4000 LC or LC/MS Autopurification system (www.waters.com), API 150 EX PrepLC/MS system (www.appliedbiosystems.com ), the Agilent 1100 series purification system for mass-based fraction collection (www.agilent.com), and the CombiFlash flash chromatography system (www.isco.com).

Similarly, the purification module can comprise a supercritical fluid chromatography (SFC) system. SFC systems are known in the art and are commercially available, e.g., from Berger Instruments, Inc. (www.bergersfc.com) or formerly from Gilson, Inc. (www.gilson.com).

Sample Processing Methods

One aspect of the present invention provides methods for processing samples. One general class of embodiments provides methods of centrifuging a sample. In the methods, a holder comprising a base plate and a lid, a container, and a sample are provided. The sample is placed into the container, and the container is placed between the base plate and the lid. The container is secured in the holder by closing the lid. The holder is placed into a centrifuge rotor, and the rotor is rotated, thereby centrifuging the sample. The holder can, e.g., be inserted directly into a rotor bucket or placed on a rotor shelf, or the holder can, e.g., be inserted into an adapter which is inserted into a rotor bucket or onto a rotor shelf. The centrifuge can be, e.g., a stand-alone centrifuge or can be attached to or part of additional equipment. For example, the centrifuge can be part of a centrifugal vacuum concentrator (e.g., a SpeedVac).

The container can be, e.g., a capacity altering device. In one class of embodiments, the container comprises a plurality of external processing regions, each of which has a capacity, and a plurality of internal processing regions that are removably sealed with the external processing regions to form a plurality of combined processing regions. In one embodiment, placing the sample into the container comprises placing the sample into at least one of the combined processing regions, wherein the total volume of the sample added to the at least one combined processing region exceeds the capacity of the external processing regions.

The holder can comprise additional parts or features, e.g., an ejection mechanism. In one embodiment, the holder's base plate comprises at least one vacuum manifold comprising a plurality of apertures in a surface of the base plate, and the method further comprises applying a vacuum to the vacuum manifold to draw the container or a portion thereof into contact with the base plate.

Another general class of embodiments provides methods of performing a sample processing operation. In the methods, a plurality of internal processing regions are removably sealed with a plurality of external processing regions to form a plurality of combined processing regions. Each of the internal processing regions has a first capacity, and each of the external processing regions has a second capacity. One or more volumes of sample comprising one or more compounds are added to the plurality of combined processing regions, and the total volume added to at least one of the combined processing regions exceeds the second capacity of the external processing regions. The one or more compounds are then processed in the plurality of combined processing regions.

The sample comprising the compound(s) is typically a liquid but can be, e.g., a gel, a powdered solid, a liquid or solid entrained in a gas (e.g., an aerosol), or a paste. The one or more compounds can comprise essentially any chemical compound, including, but not limited to, e.g., any small molecule, drug, protein, nucleic acid, polysaccharide, lipid, and the like.

In preferred embodiments, a plurality of compounds are simultaneously processed (e.g., distinct volumes of sample comprising different compounds can be added to different combined processing regions and then processed simultaneously).

In preferred embodiments, the one or more volumes of sample comprising the one or more compounds comprise at least one solvent, and the processing comprises evaporating the solvent, e.g., to concentrate the one or more compounds or to provide dried compounds. The solvent can be evaporated by any method known in the art, for example, by placing the one or more compounds in the combined processing regions into a lyophilizer or an evaporator (e.g., a nitrogen blow-down evaporator, an infrared vortex evaporator, or a standard centrifugal vacuum concentrator, e.g., a SpeedVac). The at least one solvent can be essentially any known in the art, including, but not limited to, water, ethanol, methanol, methylene chloride, chloroform, dimethyl sulfoxide (DMSO), dimethyl formamide (DMF), tetrahydrofuran (THF), isopropanol, a hexane, ethyl acetate, or acetonitrile. The processing can additionally or alternatively comprise evaporating one or more volatile components that are not solvents, e.g., trifluroacetic acid or ammonium hydroxide.

In certain embodiments, processing the one or more compounds comprises centrifuging the one or more volumes of sample. Such centrifugation can occur, e.g., in a stand-alone centrifuge or in a centrifuge that is part of or attached to additional equipment (e.g., the centrifuge can be part of a centrifugal vacuum concentrator). The purpose of the centrifugation can be, e.g., to pellet solids or to facilitate liquid-liquid extraction or vacuum concentration.

In one class of embodiments, processing the one or more compounds comprises purifying the one or more compounds. Such purification can be, e.g., by solid-liquid extraction, liquid-liquid extraction (e.g., phenol-chloroform extraction or ethyl acetate-water extraction), precipitation (e.g., with ethanol or ammonium sulfate), or crystallization. It will be appreciated that, as used herein, purifying refers to increasing the purity of the one or more compounds, not necessarily rendering them absolutely homogenous. Processing the one or more compounds can involve multiple operations (e.g., purification of the one or more compounds and evaporation of the solvent).

The one or more volumes of sample comprising the one or more compounds can be prepared or produced by essentially any means known in the art. For example, in certain embodiments, the one or more volumes of sample comprise one or more fractions from a liquid chromatography (LC) column, preferably from at least one standard preparatory liquid chromatography system. Such fractions can be produced, e.g., by dissolving the one or more compounds to be purified in at least one solvent, injecting the dissolved one or more compounds to be purified onto the standard preparatory liquid chromatography system, and identifying the one or more fractions comprising the purified one or more compounds (e.g., by UV, ELS, CLN, RI, electrochemical, or mass spectroscopic detection or timed fraction collection). A number of liquid chromatography systems are known in the art, and a number of systems (including standard preparatory liquid chromatography systems) are commerically available. Examples of commercially available standard preparatory LC systems include, but are not limited to, the Waters Delta Prep 4000 LC or LC/MS Autopurification system (www.waters.com), API 150 EX PrepLC/MS system (www.appliedbiosystems.com ), and the Agilent 1100 series purification system for mass-based fraction collection (www.agilent.com). Examples of other LC systems include, e.g., the CombiFlash flash chromatography system (www.isco.com). Although they can be used to process essentially any number of samples, the methods are particularly convenient for processing a large number of samples simultaneously; thus, in certain embodiments, at least one block of about 24, about 48, or about 96 fractions is collected in the combined processing regions. The compounds comprising the fractions can be processed, e.g., by concentrating the block of fractions using a standard centrifugal vacuum concentrator.

The methods can comprise additional steps. For example, after the one or more compounds are processed in the combined processing regions, the internal and external processing regions can be uncoupled or detached, e.g., with the processed (e.g., purified, pelleted, concentrated, and/or dried) one or more compounds remaining in the external processing regions. In one embodiment, after the one or more compounds are processed in the combined processing regions, the internal and external processing regions are uncoupled, and the one or more compounds are processed in the external processing regions at one or more workstations. The one or more workstations can comprise, e.g., at least one balance, e.g., for weighing to determine the mass of the one or more compounds where the external processing regions comprise individually pre-weighed sample tubes.

Another general class of embodiments provides methods of collecting one or more compounds. In the methods, at least one internal processing region is removably sealed with at least one external processing region to form at least one combined processing region. Each internal processing region has a first capacity, and each external processing region has a second capacity. One or more volumes of sample comprising one or more compounds are added to the combined processing region, and at least a portion of the one or more compounds is collected in the external processing region. The internal and external processing regions are then uncoupled.

In one class of embodiments, the at least one internal processing region comprises a plurality of internal processing regions, the at least one external processing region comprises a plurality of external processing regions, and the at least one combined processing region comprises a plurality of combined processing regions. In these embodiments, distinct volumes of sample, e.g., comprising distinct compounds, are typically added to two or more of the combined processing regions.

The one or more compounds can comprise essentially any chemical compound, including, but not limited to, any small molecule, drug, protein, nucleic acid, polysaccharide, lipid, and the like. The sample comprising the compound(s) is typically a liquid or solid entrained in a gas (e.g., an aerosol), but can be, e.g., a liquid, a gel, a powdered solid, or a paste. In one class of embodiments, the one or more volumes of sample comprises a gaseous phase and a liquid phase (e.g., a liquid entrained in a gas, e.g., an aerosol; e.g., wherein the liquid phase comprises the one or more compounds), and the liquid phase is collected in the external processing region.

The one or more volumes of sample comprising the one or more compounds can be prepared or produced by essentially any means known in the art. In one class of preferred embodiments, the one or more volumes of sample comprise one or more fractions from at least one supercritical fluid chromatography (SFC) system. Such fractions can be produced, e.g., by dissolving the one or more compounds to be purified in at least one solvent, injecting the dissolved one or more compounds to be purified onto the SFC system, and identifying the one or more fractions comprising the purified one or more compounds (e.g., by UV, ELS, CLN, RI, electrochemical, or mass spectroscopic detection or timed fraction collection). A number of SFC systems are known in the art, and examples of commercially available SFC systems include, but are not limited to, those available from Berger Instruments, Inc. (www.bergersfc.com) and formerly available from Gilson, Inc. (www.gilson.com). SFC uses a supercritical gas (e.g., liquefied carbon dioxide) as one component of the mobile phase. After passage through the SFC column, the compressed gas is permitted to expand, e.g., in a collection vessel having sufficient volume (e.g., in a capacity altering device of this invention), leaving the compound(s) of interest behind, e.g., in a relatively small volume of solvent (e.g., in an external processing region of the capacity altering device). SFC is reviewed in, e.g., Berger et al "Semipreparative chiral separations using supercritical fluid chromatography with stacked injections" *American Laboratory News* October 2002.

The methods can comprise additional steps. For example, after the external processing region containing at least a portion of the one or more compounds has been uncoupled from the internal processing region, the one or more compounds can be processed in the external processing region. In one embodiment, the one or more volumes of sample comprise at least one solvent, and the processing comprises evaporating the solvent (e.g., in a lyophilizer or evaporator). As another example, the processing can comprise determining the mass of the one or more compounds.

While the foregoing invention has been described in some detail for purposes of clarity and understanding, it will be clear to one skilled in the art from a reading of this disclosure that various changes in form and detail can be made without departing from the true scope of the invention. For example, all the techniques and apparatus described above can be used in various combinations. All publications, patents, patent applications, and/or other documents cited in this application are incorporated by reference in their entirety for all purposes to the same extent as if each individual publication, patent, patent application, and/or other document were individually indicated to be incorporated by reference for all purposes.

What is claimed is:

1. A capacity alterina device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity;

a plurality of external processing regions, each of the external processing regions having a second capacity; and at least one sealing mechanism, coupled to or configured to be coupled to the body structure, and configured to removably seal the plurality of internal processing regions with the plurality of external processing regions;

wherein the plurality of internal processing regions are removably sealed with the plurality of external processing regions to form a plurality of combined processing regions;

wherein the combined processing regions do not comprise a filter or frit; and wherein each of the inner cavities comprises at least one angled region, which angled region facilitates a flow of one or more volumes of liquid from the inner cavity to one of the external processing regions.

2. A capacity altering device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity;

a plurality of external processing regions, each of the external processing regions having a second capacity; and at least one sealing mechanism, coupled to or configured to be coupled to the body structure, and configured to removably seal the plurality of internal processing regions with the plurality of external processing regions;

wherein the plurality of internal processing regions are removably sealed with the plurality of external processing regions to form a plurality of combined processing regions;

wherein the combined processing regions do not comprise a filter or frit; and wherein the first capacity is at least about 1 mL, at least about 2 mL, at least about 3 mL, at least about 5 mL, or at least about 10 mL.

3. A capacity altering device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity;

a plurality of external processing regions, each of the external processing regions having a second capacity; and at least one sealing mechanism, coupled to or configured to be coupled to the body structure, and configured to removably seal the plurality of internal processing regions with the plurality of external processing regions;

wherein the plurality of internal processing regions are removably sealed with the plurality of external processing regions to form a plurality of combined processing regions;

wherein the combined processing regions do not comprise a filter or frit; and wherein each of the second access apertures is circular, and wherein the sealing mechanism comprises a plurality of extensions projecting from a bottom surface of the body structure, each extension having a terminus at which one of the second access apertures is located.

4. The device of claim 3, wherein the extensions are angled extensions, wherein the outer diameter of a cross-section of each extension is greatest near the body structure and least at the terminus of the extension.

5. The device of claim 3, wherein the plurality of internal processing regions is removably sealed with the plurality of external processing regions, each of which external processing regions comprises a circular aperture, and wherein the extensions from the body structure form one or more pressed seals with the external processing regions.

6. The device of claim 3, wherein the at least one sealing mechanism further comprises at least one gasket that is located between the plurality of extensions and the plurality of external processing regions.

7. A capacity altering device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity;

a plurality of external processing regions, each of the external processing regions having a second capacity; and at least one sealing mechanism, coupled to or configured to be coupled to the body structure, and configured to removably seal the plurality of internal processina regions with the plurality of external processing regions;

wherein the plurality of internal processing regions are removably sealed with the plurality of external processing regions to form a plurality of combined processing regions; wherein the combined processing regions do not comprise a filter or frit; and wherein the device or a portion thereof is contained in a holder;

wherein the holder comprises a base plate, a lid, and a coupling mechanism, which coupling mechanism couples the base plate to the lid in at least a first fixed position.

8. A capacity altering device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity;

a plurality of external processing regions, each of the external processing regions having a second capacity; and at least one sealing mechanism, coupled to or configured to be coupled to the body structure, and configured to removably seal the plurality of internal processing regions with the plurality of external processing regions;

wherein the plurality of internal processing regions are removably sealed with the plurality of external processing regions to form a plurality of combined processing regions; wherein the combined processing regions do not comprise a filter or frit; and wherein the device or a portion thereof is contained in a holder;

wherein the holder comprises a base, a top plate, and a coupling mechanism, which coupling mechanism couples the base to the top plate in at least a first fixed position.

9. A capacity altering device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity;

a plurality of external processing regions, each of the external processing regions having a second capacity; and at least one sealing mechanism, coupled to or configured to be coupled to the body structure, and configured to removably seal the plurality of internal processing regions with the plurality of external processing regions;

wherein the plurality of internal processing regions are removably sealed with the plurality of external processing regions to form a plurality of combined processing regions; wherein the combined processing regions do not comprise a filter or frit; and wherein the device or a portion thereof is contained in a holder;

wherein the holder is configured to be inserted into a centrifuge carrier and rotated in a centrifuge.

10. A capacity altering device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity, wherein the first capacity is at least about 1 mL;

a plurality of external processing regions, each of the external processing regions having a second capacity; and at least one sealing mechanism, coupled to or configured to be coupled to the body structure, and configured to removably seal the plurality of internal processing regions with the plurality of external processing regions;

wherein the plurality of internal processing regions are removably sealed with the plurality of external processing regions to form a plurality of combined processing regions, which combined processing regions consist of the internal processing regions removably sealed with the external processing regions.

11. A capacity altering device, comprising:

at least one body structure, comprising a plurality of first access apertures connected to, and separated from, a plurality of second access apertures by a plurality of inner cavities, the inner cavities comprising a plurality of internal processing regions, each of the internal processing regions having a first capacity;

a plurality of external processing regions, each of the external processing regions having a second capacity; and at least one sealing mechanism, coupled to or configured to be coupled to the body structure, and configured to removably seal the plurality of internal processing regions with the plurality of external processing regions;

wherein the plurality of internal processing regions are removably sealed with the plurality of external processing regions to form a plurality of combined processing regions;

wherein the combined processing regions do not comprise a filter or frit; and wherein the first access apertures are unobstructed by a plunger or seal.

* * * * *